US009227398B2

(12) United States Patent
Tanaka et al.

(10) Patent No.: US 9,227,398 B2
(45) Date of Patent: Jan. 5, 2016

(54) PRINTING APPARATUS AND PRINTING CONTROL METHOD THEREOF

(71) Applicant: Canon Kabushiki Kaisha, Tokyo (JP)

(72) Inventors: Hirokazu Tanaka, Inagi (JP); Tetsuya Edamura, Inagi (JP); Wakako Tanaka, Inagi (JP); Kiichiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,694

(22) Filed: Jan. 15, 2013

(65) Prior Publication Data

US 2013/0201238 A1 Aug. 8, 2013

(30) Foreign Application Priority Data

Feb. 3, 2012 (JP) ..... 2012-022474

(51) Int. Cl.
*B41J 29/38* (2006.01)
*B41J 2/045* (2006.01)
*B41J 2/21* (2006.01)

(52) U.S. Cl.
CPC ..... *B41J 2/04545* (2013.01); *B41J 2/04543* (2013.01); *B41J 2/04573* (2013.01); *B41J 2/2132* (2013.01)

(58) Field of Classification Search
USPC ..... 347/12, 41
See application file for complete search history.

(56) References Cited

U.S. PATENT DOCUMENTS 5,696,542 A * 12/1997 Matsubara et al. ..... 347/12
5,873,661 A * 2/1999 Murata et al. ..... 400/124.04
6,293,640 B1 * 9/2001 Narushima ..... 347/12
8,177,322 B2 5/2012 Nakano et al.
8,830,530 B2 9/2014 Sano et al.
2010/0033526 A1 * 2/2010 Toda et al. ..... 347/12
2011/0085189 A1 4/2011 Sano et al.
2013/0088537 A1 4/2013 Yazawa et al.

FOREIGN PATENT DOCUMENTS

JP 7-60968 A 3/1995
JP 2000-103088 A 4/2000
JP 2002-292847 A 10/2002
JP 2011-83932 A 4/2011

OTHER PUBLICATIONS

Japanese Office Action dated Oct. 30, 2015, in corresponding Japanese Application No. 2012-022474 (3 pages).

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

This invention relates to suppression of density unevenness caused by occurrence of ink-landing position shifts between print scans. In an embodiment, upon printing by scanning an inkjet printhead including printing elements, the following control is executed. That is, in order to form an image by print scans of the printhead on a single print area on a print medium, image data are acquired in correspondence with the respective scans. Also, the printing elements are partitioned into plural groups each including continuously arrayed printing elements, and the printing elements in each of the plural groups are time-divisionally driven based on drive sequences. Then, the drive sequences upon time-divisional driving in respective scans are set to include elements having the same drive timings and those having different drive timings.

36 Claims, 21 Drawing Sheets

FIG. 6

| DRIVE SEQUENCE | FIRST-SCAN IMAGE DATA DRIVE BLOCK NO. | SECOND-SCAN IMAGE DATA DRIVE BLOCK NO. |
|---|---|---|
| 1 | 1 | 1 |
| 2 | 5 | 5 |
| 3 | 9 | 9 |
| 4 | 13 | 13 |
| 5 | 2 | 2 |
| 6 | 6 | 6 |
| 7 | 10 | 10 |
| 8 | 14 | 14 |
| 9 | 3 | 3 |
| 10 | 7 | 7 |
| 11 | 11 | 11 |
| 12 | 15 | 15 |
| 13 | 4 | 4 |
| 14 | 8 | 8 |
| 15 | 12 | 12 |
| 16 | 16 | 16 |

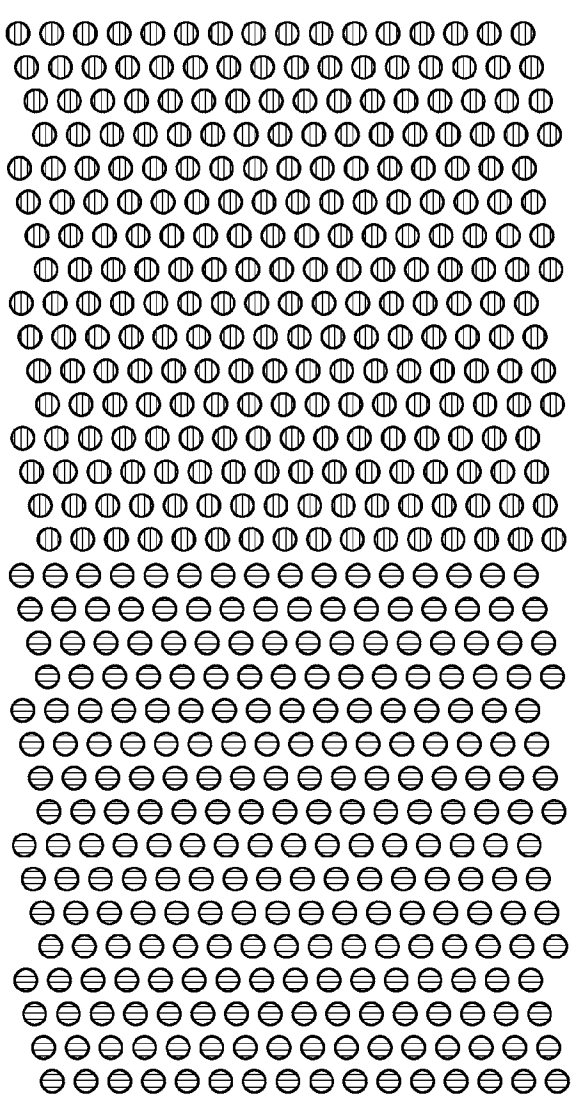
FIG. 7A
FIG. 7B
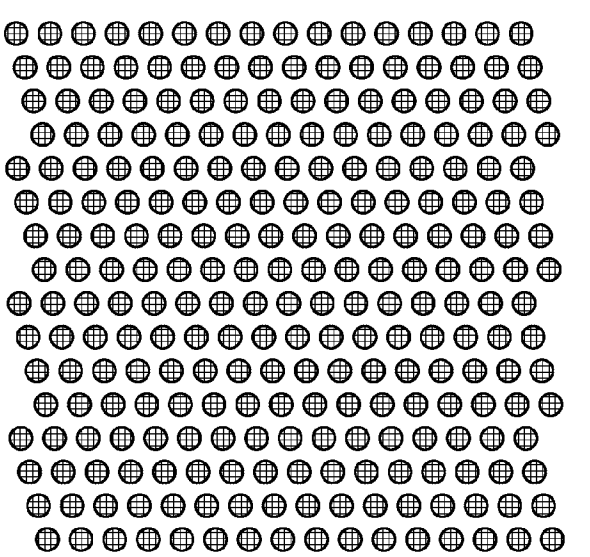
FIG. 7C
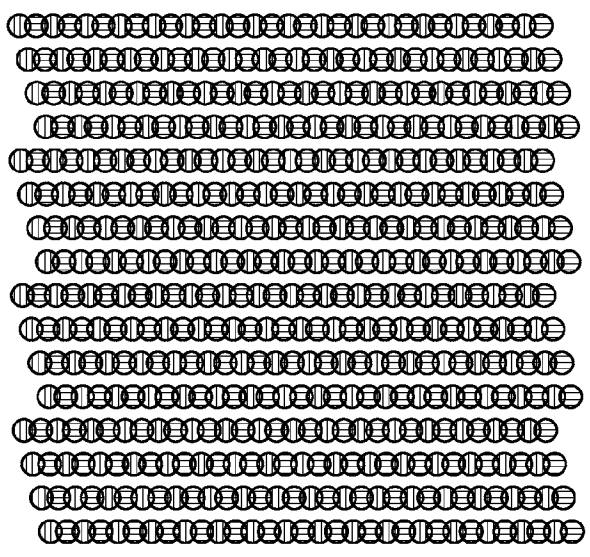
FIG. 7D

FIG. 8

| DRIVE SEQUENCE | FIRST-SCAN IMAGE DATA DRIVE BLOCK NO. | SECOND-SCAN IMAGE DATA DRIVE BLOCK NO. |
|---|---|---|
| 1 | 1 | 1 |
| 2 | 5 | 5 |
| 3 | 9 | 9 |
| 4 | 13 | 13 |
| 5 | 2 | 4 |
| 6 | 6 | 8 |
| 7 | 10 | 12 |
| 8 | 14 | 16 |
| 9 | 3 | 3 |
| 10 | 7 | 7 |
| 11 | 11 | 11 |
| 12 | 15 | 15 |
| 13 | 4 | 2 |
| 14 | 8 | 6 |
| 15 | 12 | 10 |
| 16 | 16 | 14 |

FIG. 11

| DRIVE SEQUENCE | FIRST-SCAN IMAGE DATA DRIVE BLOCK NO. | SECOND-SCAN IMAGE DATA DRIVE BLOCK NO. |
|---|---|---|
| 1 | 1 | 3 |
| 2 | 5 | 7 |
| 3 | 9 | 11 |
| 4 | 13 | 15 |
| 5 | 2 | 4 |
| 6 | 6 | 8 |
| 7 | 10 | 12 |
| 8 | 14 | 16 |
| 9 | 3 | 1 |
| 10 | 7 | 5 |
| 11 | 11 | 9 |
| 12 | 15 | 13 |
| 13 | 4 | 2 |
| 14 | 8 | 6 |
| 15 | 12 | 10 |
| 16 | 16 | 14 |

FIG. 13A

| DRIVE BLOCK NO. | DRIVE SEQUENCE REQUIRED TO PRINT FIRST-SCAN IMAGE | DRIVE SEQUENCE REQUIRED TO PRINT SECOND-SCAN IMAGE | DRIVE SEQUENCE GAP |
|---|---|---|---|
| 1 | 1 | 1 | 0 |
| 2 | 5 | 5 | 0 |
| 3 | 9 | 9 | 0 |
| 4 | 13 | 13 | 0 |
| 5 | 2 | 2 | 0 |
| 6 | 6 | 6 | 0 |
| 7 | 10 | 10 | 0 |
| 8 | 14 | 14 | 0 |
| 9 | 3 | 3 | 0 |
| 10 | 7 | 7 | 0 |
| 11 | 11 | 11 | 0 |
| 12 | 15 | 15 | 0 |
| 13 | 4 | 4 | 0 |
| 14 | 8 | 8 | 0 |
| 15 | 12 | 12 | 0 |
| 16 | 16 | 16 | 0 |

FIG. 13B

| DRIVE BLOCK NO. | DRIVE SEQUENCE REQUIRED TO PRINT FIRST-SCAN IMAGE | DRIVE SEQUENCE REQUIRED TO PRINT SECOND-SCAN IMAGE | DRIVE SEQUENCE GAP |
|---|---|---|---|
| 1 | 1 | 1 | 0 |
| 2 | 5 | 13 | 8 |
| 3 | 9 | 9 | 0 |
| 4 | 13 | 5 | 8 |
| 5 | 2 | 2 | 0 |
| 6 | 6 | 14 | 8 |
| 7 | 10 | 10 | 0 |
| 8 | 14 | 6 | 8 |
| 9 | 3 | 3 | 0 |
| 10 | 7 | 15 | 8 |
| 11 | 11 | 11 | 0 |
| 12 | 15 | 7 | 8 |
| 13 | 4 | 4 | 0 |
| 14 | 8 | 16 | 8 |
| 15 | 12 | 12 | 0 |
| 16 | 16 | 8 | 8 |

FIG. 13C

| DRIVE BLOCK NO. | DRIVE SEQUENCE REQUIRED TO PRINT FIRST-SCAN IMAGE | DRIVE SEQUENCE REQUIRED TO PRINT SECOND-SCAN IMAGE | DRIVE SEQUENCE GAP |
|---|---|---|---|
| 1 | 1 | 9 | 8 |
| 2 | 5 | 13 | 8 |
| 3 | 9 | 1 | 8 |
| 4 | 13 | 5 | 8 |
| 5 | 2 | 10 | 8 |
| 6 | 6 | 14 | 8 |
| 7 | 10 | 2 | 8 |
| 8 | 14 | 6 | 8 |
| 9 | 3 | 11 | 8 |
| 10 | 7 | 15 | 8 |
| 11 | 11 | 3 | 8 |
| 12 | 15 | 7 | 8 |
| 13 | 4 | 12 | 8 |
| 14 | 8 | 16 | 8 |
| 15 | 12 | 4 | 8 |
| 16 | 16 | 8 | 8 |

FIG. 14A

| DRIVE SEQUENCE | FIRST-SCAN IMAGE DATA DRIVE BLOCK NO. | SECOND-SCAN IMAGE DATA DRIVE BLOCK NO. |
|---|---|---|
| 1 | 1 | 1 |
| 2 | 9 | 12 |
| 3 | 6 | 7 |
| 4 | 14 | 2 |
| 5 | 3 | 1 |
| 6 | 11 | 8 |
| 7 | 8 | 3 |
| 8 | 16 | 14 |
| 9 | 5 | 9 |
| 10 | 13 | 4 |
| 11 | 2 | 15 |
| 12 | 10 | 10 |
| 13 | 7 | 5 |
| 14 | 15 | 16 |
| 15 | 4 | 11 |
| 16 | 12 | 6 |

FIG. 14B

| DRIVE BLOCK NO. | DRIVE SEQUENCE REQUIRED TO PRINT FIRST-SCAN IMAGE | DRIVE SEQUENCE REQUIRED TO PRINT SECOND-SCAN IMAGE | DRIVE SEQUENCE GAP |
|---|---|---|---|
| 1 | 1 | 1 | 0 |
| 2 | 11 | 4 | 9 |
| 3 | 5 | 7 | 2 |
| 4 | 15 | 10 | 11 |
| 5 | 9 | 13 | 4 |
| 6 | 3 | 16 | 13 |
| 7 | 13 | 3 | 6 |
| 8 | 7 | 6 | 15 |
| 9 | 2 | 9 | 7 |
| 10 | 12 | 12 | 0 |
| 11 | 6 | 15 | 9 |
| 12 | 16 | 2 | 2 |
| 13 | 10 | 5 | 11 |
| 14 | 4 | 8 | 4 |
| 15 | 14 | 11 | 13 |
| 16 | 8 | 14 | 6 |

| | FIRST-FRAME IMAGE DATA | SECOND-FRAME IMAGE DATA |
|---|---|---|
| 00 | 0 | 0 |
| 01 | 1 | 0 |
| 10 | 1 | 1 |

FIG. 20

| DRIVE SEQUENCE | FIRST-FRAME IMAGE DATA DRIVE BLOCK NO. | SECOND-FRAME IMAGE DATA DRIVE BLOCK NO. |
|---|---|---|
| 1 | 1 | 1 |
| 2 | 5 | 5 |
| 3 | 9 | 9 |
| 4 | 13 | 13 |
| 5 | 2 | 4 |
| 6 | 6 | 8 |
| 7 | 10 | 12 |
| 8 | 14 | 16 |
| 9 | 3 | 3 |
| 10 | 7 | 7 |
| 11 | 11 | 11 |
| 12 | 15 | 15 |
| 13 | 4 | 2 |
| 14 | 8 | 6 |
| 15 | 12 | 10 |
| 16 | 16 | 14 |

PRINTING APPARATUS AND PRINTING CONTROL METHOD THEREOF

BACKGROUND OF THE INVENTION

1. Field of the Invention

The present invention relates to a printing apparatus and printing control method thereof, and particularly to a printing apparatus, which performs multipass printing by time-divisionally driving a plurality of printing elements of an inkjet printhead, and a printing control method thereof.

2. Description of the Related Art

Of many inkjet printing apparatuses, a serial type inkjet printing apparatus, in which a printhead including a plurality of nozzles is mounted on a carriage, and which forms a print image by repeating a carriage scan and intermittent conveyance of a print medium, has prevailed, since it is inexpensive and compact.

In such a printing apparatus, density unevenness often occurs on a print image due to variations of nozzle diameters and of ink discharge directions. In order to suppress this density unevenness, multipass printing, which completes printing by complementing one pixel by printing operations of a plurality of carriage scans, is used. Multipass printing has the aforementioned advantage, but it also has a disadvantage. That is, in the plurality of carriage scans required to complete printing, unexpected ink-landing position shifts caused by, for example, an uneven surface of a print medium, have occurred between a certain scan and another scan, thus causing density unevenness of an image on that occurrence area.

To solve such a problem, for example, Japanese Patent Laid-Open No. 2000-103088 has proposed the following method. That is, multi-valued image data is divided into data for a plurality of times used to scan a predetermined area, data conversion of the divided multi-valued image data is performed using different coefficients, and binarization processing is applied to the respective converted data. According to this method, since some pixels have an opportunity of receiving ink discharged twice or more in a plurality of print scans, a situation in which all pixels have a complementary relation can be avoided. As a result, multipass printing, which hardly causes density changes of an image even when ink-landing position shifts have occurred between print scans, can be realized.

The aforementioned related art has a sufficiently high effect when one dot per pixel is allotted on an average. However, when a high-density image is to be output, dots more than one dot per pixel have to be allotted, and in such a case a new problem is posed.

FIGS. 21A to 21C are views for explaining the conventional problem.

FIG. 21A shows a conventional dot allotment when all pixels are completely complemented without using the method proposed by Japanese Patent Laid-Open No. 2000-103088. Also, FIG. 21B shows a dot allotment when some non-complemented pixels are generated using the method proposed by Japanese Patent Laid-Open No. 2000-103088. Furthermore, FIG. 21C shows a dot allotment when two dots are allotted per pixel using Japanese Patent Laid-Open No. 2000-103088.

Black dots shown in FIGS. 21A to 21C are allotted in a first print scan, white dots are allotted in a second print scan, and gray dots are allotted in the first and second print scans. The left figure of each of FIGS. 21A to 21C shows a case free from any ink-landing position shifts between the first and second print scans, and the right figure shows a case in which ink-landing position shifts have occurred between the first and second print scans.

In the case shown in FIG. 21A, if no ink-landing position shifts occur between the print scans, white and black dots are neatly aligned in a checkerboard pattern. However, when ink-landing position shifts have occurred, white dots get closer to black dots, and partially overlap each other. Thus, a state in which a print area is not filled is formed compared to an original state. In this manner, when ink-landing position shifts have occurred at certain timings in an image area, the state shown in the left figure in FIG. 21A and that shown in the right figure are formed at adjacent positions, and this state is visually recognized as density unevenness.

On the other hand, the case shown in FIG. 21B includes pixels on which no dots are printed, and those on which dots are printed by both the first and second print scans when no ink-landing position shifts occur. Hence, when ink-landing position shifts have occurred, originally overlapped dots appear, and separated dots overlap each other, thus suppressing a density change due to the presence/absence of ink-landing position shifts as a whole. The reason why white dots and black dots have different allotments even when ink-landing position shifts do not occur is that parameters associated with binarization processing (error diffusion processing in this case) are different for white dots and black dots. In this case, when an image having a higher density than the example shown in FIG. 21B, generation ratios of both white dots and black dots have to be increased.

The case shown in FIG. 21B has higher degrees of freedom in pixel positions where both white and black dots are allotted. However, when dot generation ratios are to be increased, the number of dots to be allotted has to be increased, thus lowering degrees of freedom in allotment. This cannot be coped with by the data ratios between the first and second print scans and the contents of a diffusion matrix described in Japanese Patent Laid-Open No. 2000-103088. When dot generation ratios are to be increased, the state shown in the left figure of FIG. 21C is reached at last, and all pixels are configured by gray dots printed in the first and second print scans, thus printing an image having a highest density. However, in this state, all overlapped dots unwantedly appear when ink-landing position shifts between scans have occurred, and density changes caused by the presence/absence of ink-landing position shifts become large, as shown in the right figure of FIG. 21C. As a result, such state is visually recognized as density unevenness, as described above.

SUMMARY OF THE INVENTION

Accordingly, the present invention is conceived as a response to the above-described disadvantages of the conventional art.

For example, a printing apparatus and printing control method according to one embodiment of this invention are capable of suppressing density unevenness which appears when ink-landing position shifts have occurred.

According to one embodiment of the present invention, there is disclosed a printing apparatus comprising a printhead having an element array including a plurality of printing elements which discharge ink. The element array is partitioned into a plurality of groups each including a plurality of continuously arrayed printing elements. The apparatus further comprises: a scan unit configured to scan the printhead; and an acquisition unit configured to externally acquire first print data used in printing in a first scan and second print data used in printing in a second scan. The first print data and the second print data are used to be printed on a single print area on a print medium. The apparatus further comprises: a setting unit configured to set drive sequences of time-divisional driving respectively in the first scan and the second scan so as to, in each group, include printing elements having the same drive timing and different drive timings of the time-divisional driving of the plurality of printing elements in the first scan and the second scan; and a drive unit configured to time-divisionally drive the plurality of printing elements in each group based on the drive sequences.

According to another embodiment of the present invention, there is disclosed a printing control method of a printing apparatus, which includes a printhead comprising an element array including a plurality of printing elements which discharge ink, and attains printing by reciprocally scanning the printhead, wherein the element array is partitioned into a plurality of groups each including a plurality of continuously arrayed printing elements. The method comprises: externally acquiring first print data used in printing in a first scan and second print data used in printing in a second scan, wherein the first print data and the second print data are used to be printed on a single print area on a print medium; setting drive sequences of time-divisional driving respectively in the first scan and the second scan so as to, in each group, include printing elements having the same drive timing and different drive timings of the time-divisional driving of the plurality of printing elements in the first scan and the second scan; and time-divisionally driving the plurality of printing elements in each group based on the drive sequences.

The embodiment according to the invention is particularly advantageous since density unevenness that appears when ink-landing position shifts have occurred can be suppressed even when one or more dots are printed per pixel on an average.

Further features of the present invention will become apparent from the following description of exemplary embodiments (with reference to the attached drawings).

BRIEF DESCRIPTION OF THE DRAWINGS

FIG. 6 is a table showing drive sequence settings according to the related art.

FIGS. 7A, 7B, 7C, and 7D are views showing allotments of print dots in case of the drive block sequence settings shown in FIG. 6.

FIG. 8 is a table showing drive sequences set upon execution of 2-pass printing using first scan image data 408-1 and second scan image data 408-2.

FIG. 11 is a table showing an example in which a drive block sequence upon discharging ink based on second scan image data is the same as that having a given offset amount from a drive block sequence upon discharging ink based on first scan image data.

FIGS. 13A, 13B, and 13C are tables showing drive block sequences and drive sequence gaps.

FIGS. 14A and 14B are tables showing another example of drive block sequences to which an embodiment of the present invention is applied.

FIG. 20 is a table showing drive block sequences used in the second embodiment.

DESCRIPTION OF THE EMBODIMENT

Figure 1A:
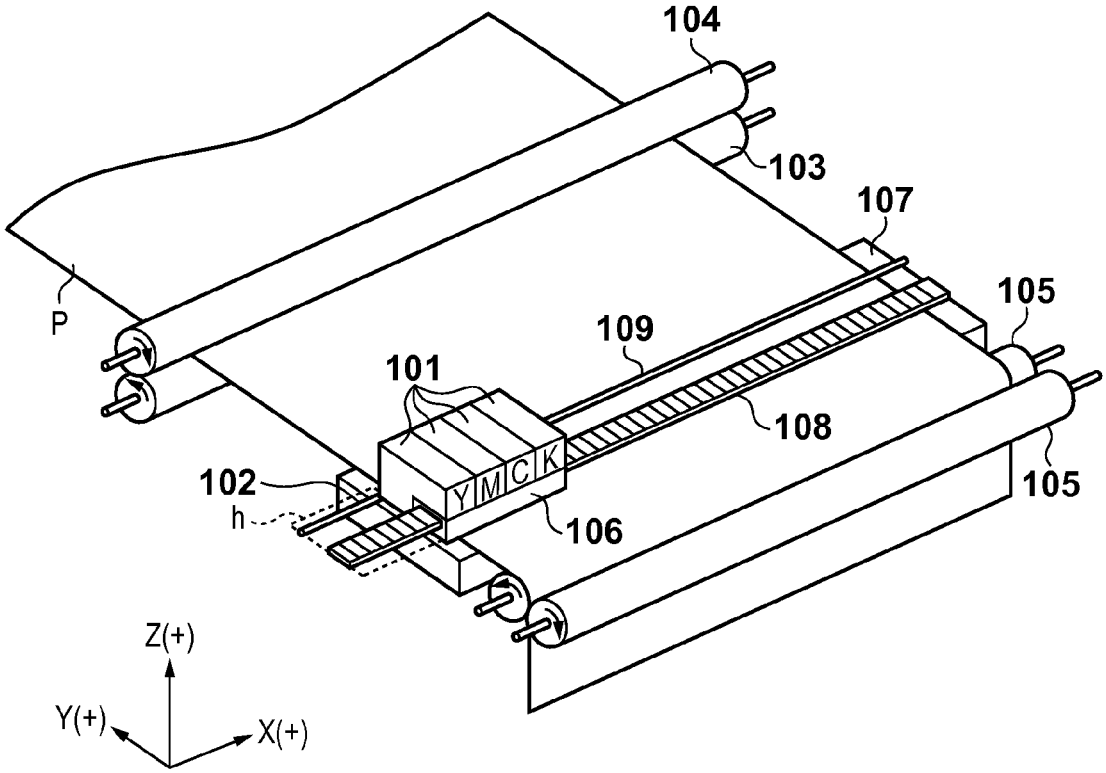
FIGS. 1A and 1B are schematic views showing the arrangement of an inkjet printing apparatus as an exemplary embodiment of the present invention.

Exemplary embodiments of the present invention will now be described in detail in accordance with the accompanying drawings. Note that the same reference numerals denote already explained parts, and a repetitive description thereof will be avoided.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<Basic Arrangement of Inkjet Printing Apparatus (FIGS. 1A to 3C)>

Figure 1B:
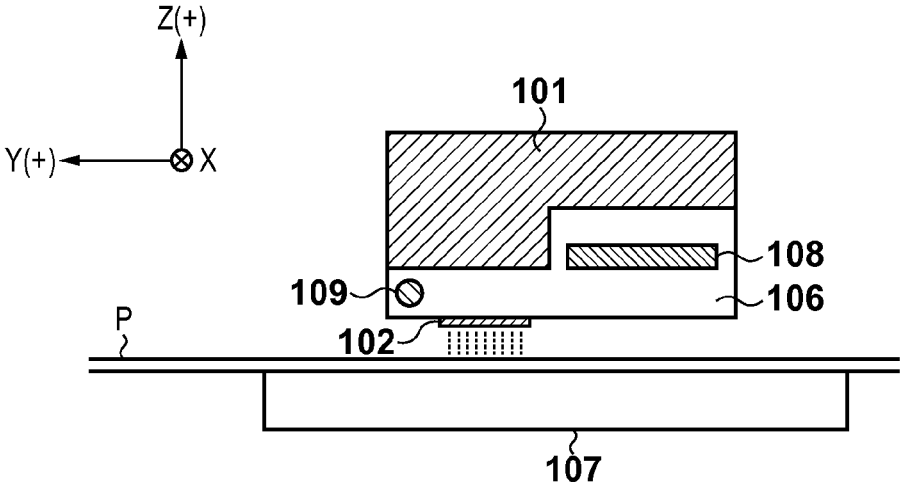

FIGS. 1A and 1B are schematic views showing the arrangement of an inkjet printing apparatus (to be referred to as a printing apparatus) as an exemplary embodiment of the present invention.

FIG. 1A is a perspective view of the printing apparatus, and FIG. 1B is a Y-Z cross-sectional view of a cross-section shown in FIG. 1A, which passes through an inkjet printhead (to be referred to as a printhead hereinafter).

Referring to FIGS. 1A and 1B, reference numeral 101 denotes ink cartridges which respectively contain cyan (C), magenta (M), yellow (Y), and black (K) inks; 102, a printhead which discharges ink droplets onto an opposing print medium P; 103, a conveyance roller; and 104, an auxiliary roller. The conveyance roller 103 and auxiliary roller 104 are rotated in directions of arrows in FIG. 1A while pressing the print medium P in cooperation with each other, and convey the white print medium in a +Y direction as needed. Reference numeral 105 denotes a feed roller, which is used to feed the print medium P, and also plays a role in pressing the printing sheet P in the same manner as the conveyance roller 103 and auxiliary roller 104.

Reference numeral 106 denotes a carriage which supports the ink cartridges 101 and moves them as printing progresses. The carriage 106 stands by at a home position h as that indicated by the dotted line in FIG. 1A when it does not perform printing or when a recovery operation of the printhead 102 or the like is to be performed. Reference numeral 107 denotes a platen which plays a role in stably supporting the print medium P at a printing position; 108, a carriage belt which scans the carriage 106 in an X direction; and 109, a carriage shaft which supports the carriage 106.

This printing apparatus forms an image by alternately repeating carriage scans in ±X directions and conveyance of the print medium in the +Y direction. In this case, assume that there is ideally no shift in the X direction between a certain scan and next scan. However, a shift may unexpectedly occur in the X direction depending on the scan precision of the carriage 106 and the conveyance precision of the conveyance roller 103 and auxiliary roller 104.

Figure 2A:
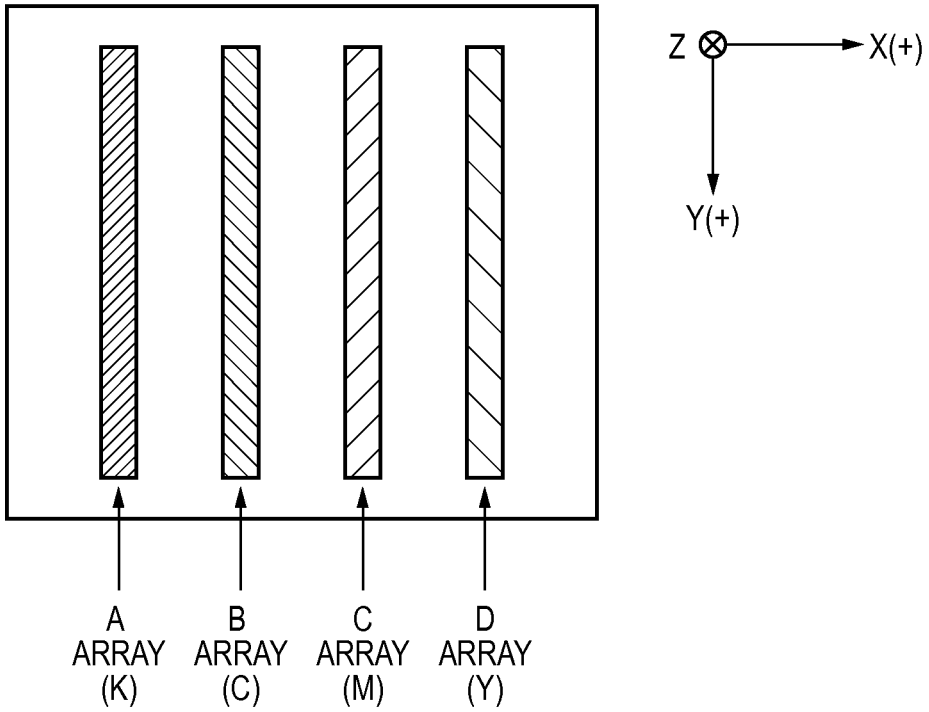
FIGS. 2A and 2B are views showing the arrangement of a printhead.
Figure 2B:
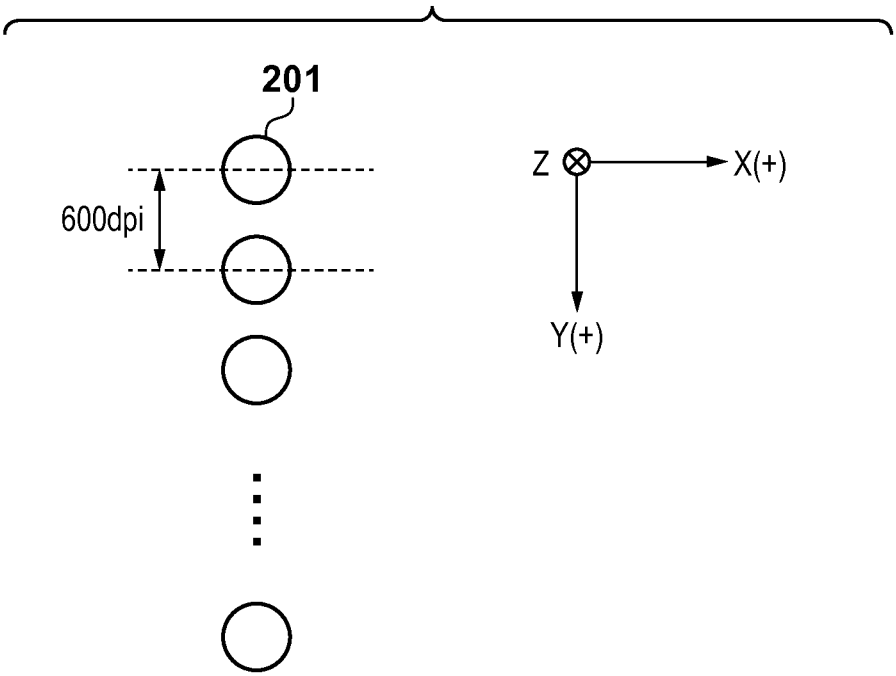

FIGS. 2A and 2B are views showing the arrangement of the printhead 102. FIG. 2A is a plan view of the printhead when viewed from a Z direction, and FIG. 2B is an enlarged view around nozzles. As can be seen from FIG. 2A, the printhead 102 includes four nozzle arrays (A array, B array, C array, and D array) each having the same arrangement.

In FIG. 2A, the A array discharges black ink, the B array discharges cyan ink, the C array discharges magenta ink, and the D array discharges yellow ink. FIG. 2B is an enlarged view of, especially, the A array. The A array is formed from nozzles 201 which discharge 2-pico liter ink droplets. Nozzles are arranged at 600-dpi intervals in respect with an array direction (Y direction) of the nozzles. A heater (not shown) is disposed immediately below (+Z direction) each nozzle. When the heater is heated, ink immediately above the heater forms bubbles, thereby discharging ink from the nozzle. FIG. 2B illustrates only four nozzles in an in-array direction (Y direction), but 256 nozzles are arranged in practice.

In a printing apparatus using a printhead on which a large number of orifices are arrayed in this way, a large-capacity power supply is required to discharge inks at the same timing by simultaneously driving all the orifices. For this reason, a method of time-divisionally driving the predetermined number of heaters arrayed in the printhead within a period of a drive cycle is adopted. More specifically, all the heaters (all the nozzles) of the printhead are partitioned into 16 groups, and printing is performed by changing the drive timings of heaters in the groups little by little. By executing the time-divisional driving in this manner, since the number of heaters to be simultaneously driven is reduced, a capacity of the power supply required for the printing apparatus can be suppressed.

Figures 3A, 3B, 3C:
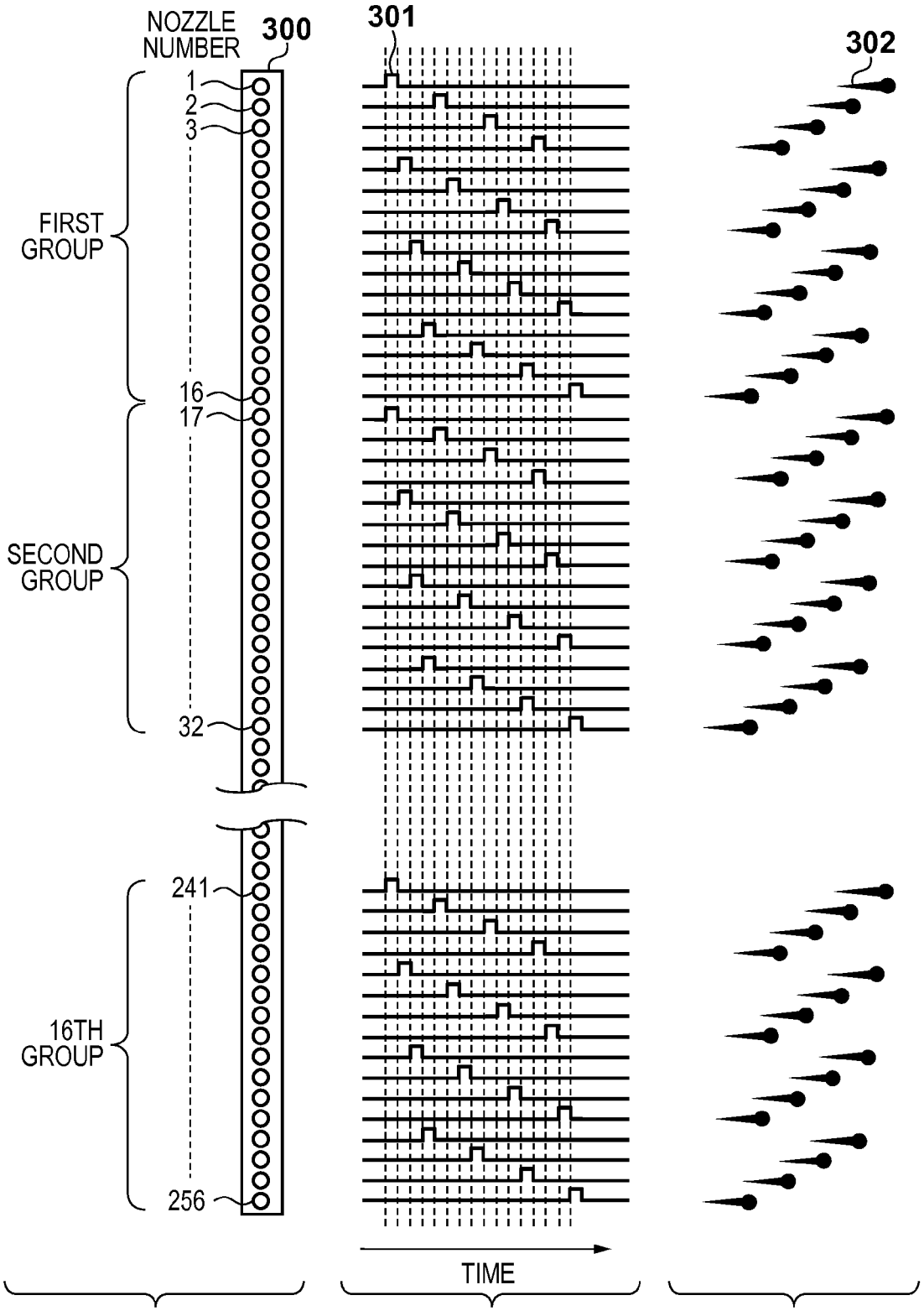
FIGS. 3A, 3B, and 3C are views illustrating an A array of nozzle arrays of the printhead, drive signals applied to respective nozzles, and flying ink droplets discharged from the respective nozzles.

FIGS. 3A to 3C schematically show the A array of the nozzle arrays of the printhead, drive signals to be applied to respective nozzles, and flying ink droplets discharged from the respective nozzles.

As shown in FIG. 3A, a nozzle array 300 of the printhead 102 includes 256 nozzles, which are partitioned into 16 groups from a first group to 16th group, each including continuous 16 nozzles in turn from the top of FIG. 3A. Furthermore, each of the 16 nozzles in each group belongs to one of 16 drive blocks, and these nozzles are sequentially time-divisionally driven for respective blocks upon printing. That is, printing for one column is driven while being partitioned into 16 timings.

In the time-divisional driving, nozzles which belong to the same block are simultaneously driven. In the illustrated example, 16 nozzles of nozzle Nos. 1, 17, . . . , 241 of the nozzle array 300 belong to a first drive block (drive block No. 1), and 16 nozzles of nozzle Nos. 5, 21, . . . , 245 belong to a second drive block (drive block No. 2). Likewise, 16 nozzles of nozzle Nos. 16, 32, . . . , 256 belong to a 16th drive block (drive block No. 16). In this way, the nozzles in the respective groups are periodically assigned to the respective drive blocks.

In case of the time-divisional driving upon driving the nozzles in a sequence of drive block Nos. 1, 5, 9, 13, 2, 6, 10, 14, 3, 7, 11, 15, 4, 8, 12, and 16, respective heaters are sequentially driven by pulse-shaped drive signals 301 shown in FIG. 3B. In response to the drive signals, ink droplets 302 are discharged from the nozzles, as shown in FIG. 3C.

Two embodiments will be described hereinafter in association with a printing control method using the printing apparatus with the above arrangement.

First Embodiment

Figure 4:
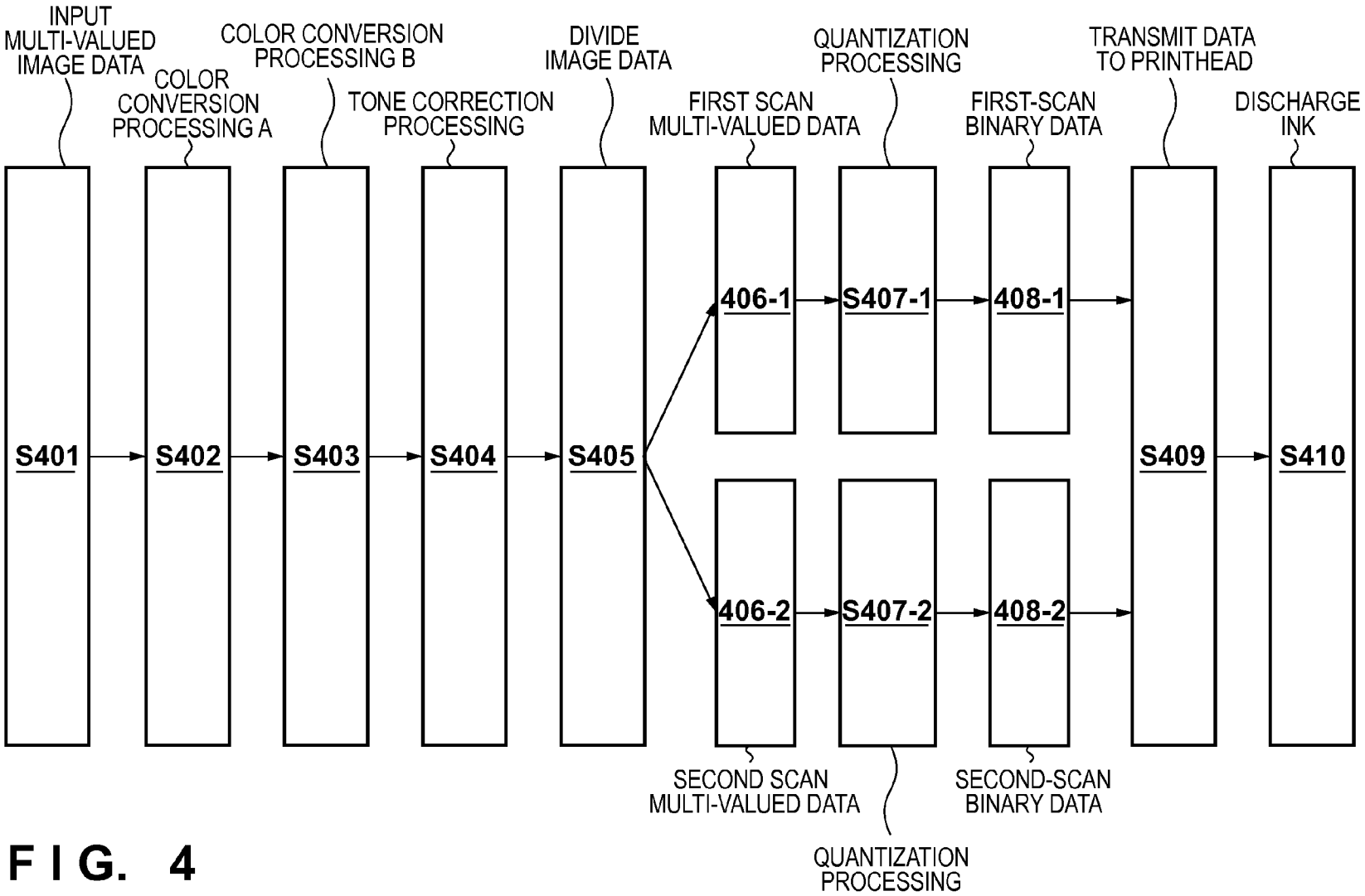
FIG. 4 is a flowchart for explaining processing of multipass printing which completes image printing of a single area by two print scans according to the first embodiment.

FIG. 4 is a flowchart for explaining processing of multipass printing, which completes image printing of a single print area on a print medium by two print scans.

In step S401, R, G, and B original image signals, which are obtained by an image input device such as a digital camera or scanner or by computer processing, are input at a resolution of 600 dpi. In step S402, the R, G, and B original image signal input in step S401 are converted into R', G', and B' signals by color conversion processing A. Furthermore, in step S403, the R', G', and B' signals are converted into signal values corresponding to respective color inks by color conversion processing B. Since the printing apparatus of this embodiment adopts the 4-color ink configuration, the converted signals are image signals K1, C1, M1, and Y1 corresponding to ink colors K (black), C (cyan), M (magenta), and Y (yellow). Note that the practical color conversion processing B uses a three-dimensional lookup table (not shown) which describes the relation between R, G, and B input values and K, C, M, and Y output values, and calculates an input value which falls outside table grid point values by interpolation from output values at its surrounding table grid points.

The following description will be given in association with the K (black) image signal K1 as a representative of the image signals.

In step S404, tone correction of the image signal K1 is executed using a tone correction table to obtain an image signal K2 after the tone correction. In step S405, the signal value of the image signal K2 after the tone correction is halved to separate that value into first scan multi-valued data 406-1 to be printed in only a first print scan, and second scan multi-valued data 406-2 to be printed in only a second print scan. In steps S407-1 and S407-2, quantization processing based on error diffusion is executed for the respective scan multi-valued data, thus obtaining binarized first scan image data 408-1 and second scan image data 408-2. The resolution of each of the first scan image data 408-1 and second scan image data 408-2 is 600 dpi. In this manner, by executing the quantization processing (steps S407-1 and S407-2) after the image data is separated in step S405, image data (408-1 and 408-2) used in print scans, in which ink is discharged a plurality of times to the same position for one pixel on a print medium, are generated. Note that such image data used in the respective print scans may be generated outside the printing apparatus and may be acquired when they are used.

In step S409, these binary image data are transmitted to the printhead 102. In step S410, the heaters are driven by the time-divisional driving to discharge ink droplets, thereby printing an image.

Figure 5:
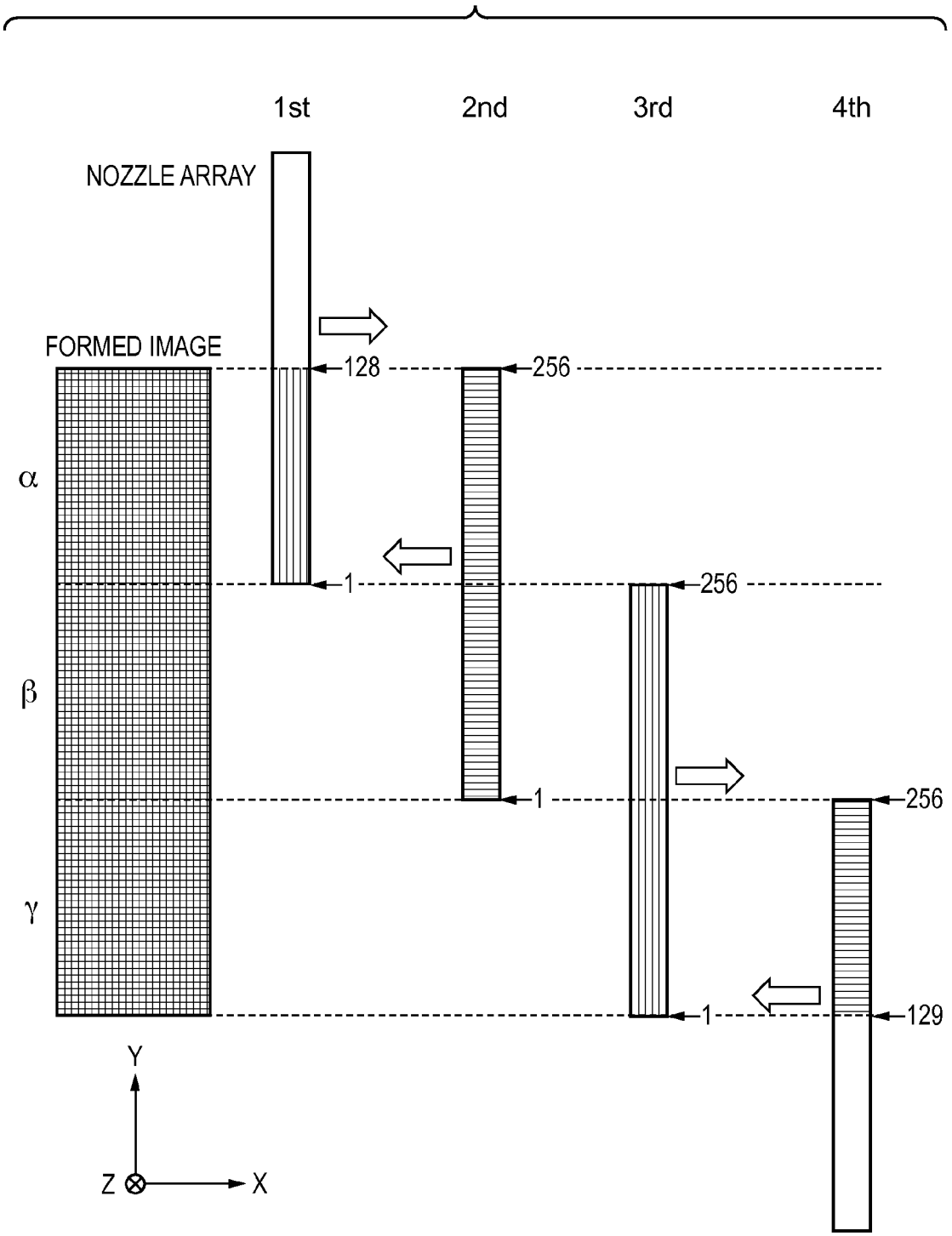
FIG. 5 is a schematic view showing the relation between conveyance of a print medium and nozzle arrays to be used at the time of image formation.

FIG. 5 is a schematic view showing the relation between print medium conveyance and nozzles to be used at the time of image formation. The following description will be given taking the A array as an example of the nozzle array, and the same relation applies to the remaining B to D arrays of the nozzle arrays.

First, using the nozzle Nos. 1 to 128, the carriage is scanned in the +X direction (forward direction) to execute printing (forward printing). Print data at this time is the first scan image data 408-1. After this scan, the print medium P is conveyed in the +Y direction by 128 nozzles in a unit of 600 dpi. FIG. 5 shows a relative positional relation between the nozzles and print medium by moving the nozzles in the −Y direction for the sake of convenience. Second, using the nozzle Nos. 1 to 256, the carriage is scanned in the −X direction (backward direction) to execute printing (backward printing). Print data at this time is the second scan image data 408-2. After this scan, the print medium P is conveyed in the +Y direction by 128 nozzles in a unit of 600 dpi. Third, using the nozzle Nos. 1 to 256, the carriage is scanned in the +X direction to execute printing. Print data at this time is the first scan image data 408-1. After this scan, the print medium P is conveyed in the +Y direction by 128 nozzles in a unit of 600 dpi. Fourth, using the nozzle Nos. 129 to 256, the carriage is scanned in the −X direction to execute printing. Print data at this time is the second scan image data 408-2. After this scan, the print medium P is discharged, thus ending printing.

Printing of image areas α, β, and γ to be formed by the aforementioned operations is completed by adding two binary data; that is, the first scan image data 408-1 and second scan image data 408-2.

Next, a case will be described below wherein a total of two dots; that is, one dot based on the first scan image data 408-1 and one dot based on the second scan image data 408-2 are allotted per pixel with respect to all the pixels.

FIG. 6 shows drive sequence settings according to the related art.

FIG. 6 shows drive block sequences under the assumption that images based on both the first and second scan image data are printed by carriage scans in the +X direction. In case of printing by carriage scans in the −X direction, the drive sequence is set to be a reversed sequence like 16, 15, 14, . . . , 1 so as to obtain the same print dot allotments as those by the carriage scans in the +X direction.

In the related art, as shown in FIG. 6, the same drive sequence is selected for both the first scan image data 408-1 and second scan image data 408-2.

FIGS. 7A to 7D show print dot allotments in case of the drive block sequence settings shown in FIG. 6.

FIG. 7A shows a dot allotment printed using only the first scan image data 408-1, and FIG. 7B shows a dot allotment printed using only the second scan image data 408-2. FIG. 7C shows a final dot allotment when dots printed using the first scan image data 408-1 and second scan image data 408-2 are printed to overlap each other. FIG. 7D shows a dot allotment when dots printed using the second scan image data 408-2 are shifted by +20 μm in the X direction with respect to those printed using the first scan image data 408-1 due to occurrence of shifts between print scans, from the final print dot allotment shown in FIG. 7C.

An X-direction distance between dots printed by a single nozzle is 42.3 μm (=600 dpi), and an X-direction distance between first and second blocks is 2.65 μm (=9600 dpi=600 dpi×16).

In FIGS. 7A to 7D, dots hatched by vertical lines are printed using the first scan image data 408-1, and those hatched by horizontal lines are printed using the second scan image data 408-2. Also, dots hatched by grid lines are printed using both the first scan image data 408-1 and second scan image data 408-2. As can be seen from FIG. 7C, dots based on the first scan image data 408-1 and second scan image data 408-2 are printed on all the pixels to overlap each other. On the other hand, in FIG. 7D, dots which overlap each other in FIG. 7C separately appear, thus increasing a density as a whole. For example, assuming that ink-landing position shifts of +20 μm in the X direction have occurred due to an unexpected influence of, for example, an uneven surface of a print medium during the second print scan shown in FIG. 5, the image area β has a higher density than the image areas α and γ, and is recognized as density unevenness.

Subsequently, dot printing according to the first embodiment will be described below.

FIG. 8 shows drive sequences set upon execution of 2-pass printing using the first scan image data 408-1 and second scan image data 408-2.

FIG. 8 shows drive block sequences under the assumption that printing is performed by carriage scans both in the +X direction using the first and second scan image data. When printing is performed by carriage scans in the −X direction, the drive sequence is set to be a reversed sequence like 16, 15, 14, . . . , 1 so as to obtain the same print dot allotments as those printed by the carriage scans in the +X direction. In this embodiment, as shown in FIG. 8, the block drive sequence upon execution of printing using the first scan image data 408-1 is set to be different from that upon execution of printing using the second scan image data 408-2.

FIGS. 9A to 9D show print dot allotments in case of the drive block sequence settings shown in FIG. 8.

Figure 9A:
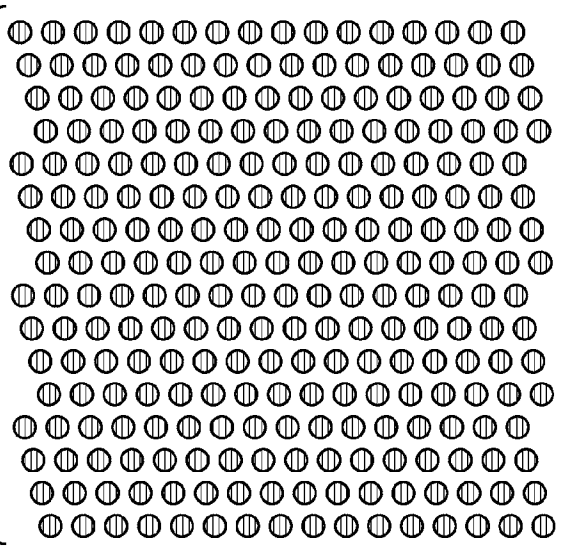
FIGS. 9A, 9B, 9C, and 9D are views showing allotments of print dots in case of the drive block sequence settings shown in FIG. 8.
Figure 9B:
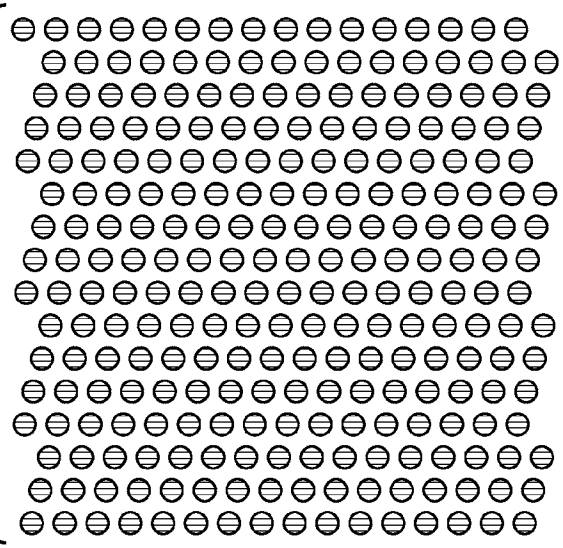
Figure 9C:
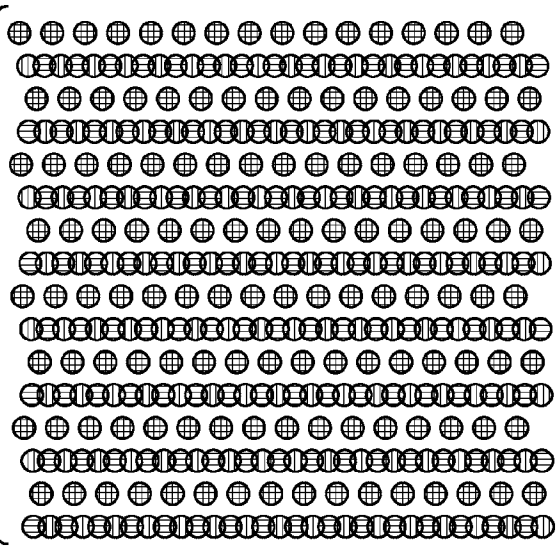
Figure 9D:
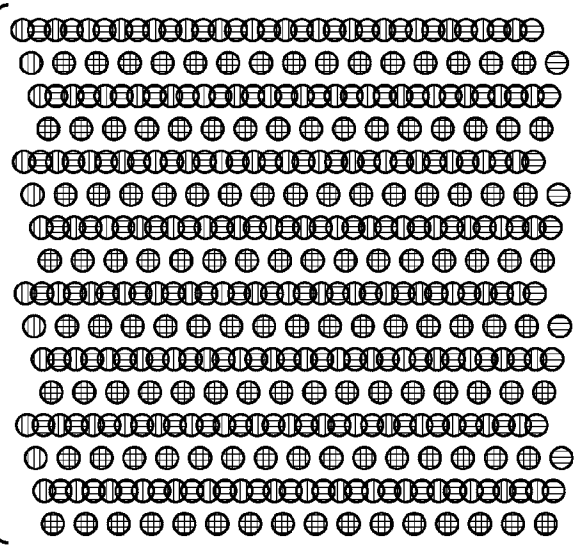

FIG. 9A shows a dot allotment printed using only the first scan image data 408-1, and FIG. 9B shows a dot allotment printed using only the second scan image data 408-2. FIG. 9C shows a final dot allotment when dots printed using the first scan image data 408-1 and second scan image data 408-2 are printed to overlap each other. FIG. 9D shows an allotment when dots printed using the second scan image data 408-2 are shifted by +20 μm in the X direction with respect to those printed using the first scan image data 408-1 due to occurrence of shifts between print scans, from the final dot allotment shown in FIG. 9C. Note that in FIGS. 9A to 9D, settings of the distance between dots printed by a single nozzle, that between the first and second blocks, and dots hatched by the vertical lines, horizontal lines, and grid lines are the same as those in FIGS. 7A to 7D.

As can be seen from FIG. 9C, the allotment includes portions where dots printed using the first scan image data 408-1 and second scan image data 408-2 overlap each other, and portions where dots are shifted without overlapping each other. On the other hand, in FIG. 9D, the overlapped dots in FIG. 9C newly appear as separated dots, while dots which are shifted without overlapping each other newly appear as overlapped dots. As a result, a density change is canceled out, and there is nearly no density difference as a whole between FIGS. 9C and 9D.

As in the related art, for example, assuming that ink-landing position shifts of +20 μm in the X direction has occurred due to an unexpected cause during the second print scan in FIG. 5, no density difference is observed between the image area β and the image areas α and γ, thus suppressing occurrence of density unevenness.

According to the aforementioned embodiment, in multi-pass printing which attains printing by overlapping a plurality of dots at one pixel position by a plurality of scans, the block drive sequences of the time-divisional driving in different print scans can be controlled to be different from each other. In this manner, even when one or more dots are to be printed per pixel on an average, density unevenness caused when ink-landing position shifts have occurred between print scans can be suppressed.

Note that the example has been explained wherein a total of two dots are allotted per pixel with respect to all the pixels. However, if there is at least one pixel on which a total of two dots are printed per pixel, this embodiment is effective, and is free from any adverse effects.

FIGS. 10A to 10D show dot allotments when the drive block sequence settings shown in FIG. 8 are applied to image data described in Japanese Patent Laid-Open No. 2000-103088 upon execution of printing.

Figure 10A:
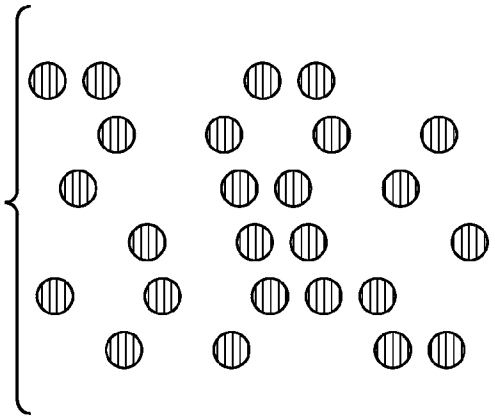
FIGS. 10A, 10B, 10C, and 10D are views showing dot allotments when the drive block sequence settings shown in FIG. 8 are applied to image data described in Japanese Patent Laid-Open No. 2000-103088 to print the image data.
Figure 10B:
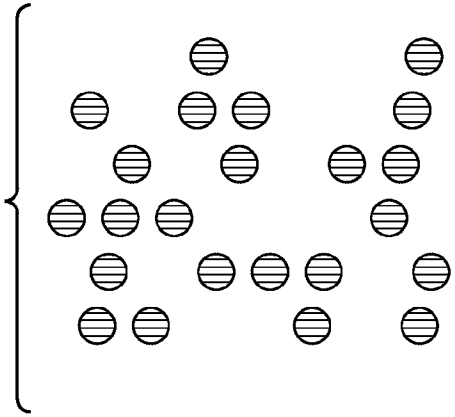
Figure 10C:
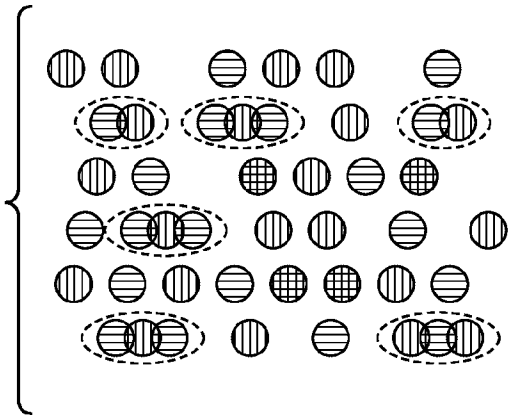
Figure 10D:
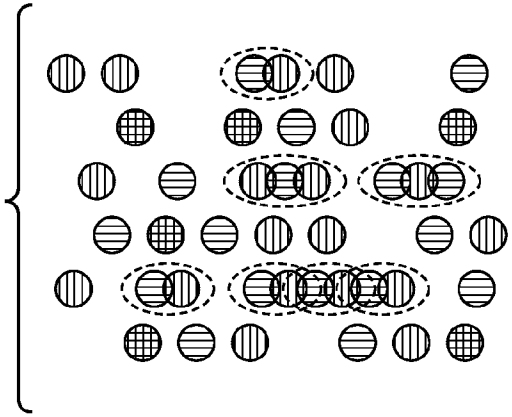

FIGS. 10A to 10D show the same dot allotments as those in FIGS. 7A to 7D and FIGS. 9A to 9D. That is, FIG. 10A shows a print dot allotment using only the first scan image data, FIG. 10B shows a print dot allotment using only the second scan image data, and FIG. 10C shows a dot allotment when print dots overlap each other using both the first and second scan image data. FIG. 10D shows a dot allotment when ink-landing positions where dots printed using the second scan image data 408-2 are formed are shifted by +20 μm in the X direction with respect to those printed using the first scan image data.

As shown in FIG. 10C, there are six (6) portions where dots printed in the first and second print scans overlap each other (those bounded by the broken lines). By contrast, as shown in FIG. 10D, there are seven (7) portions (those bounded by the broken lines). By comparing FIGS. 10C and 10D, although a density is decreased slightly when shifts between the print scans have occurred, no serious density change occurs as a whole, and this embodiment is effective.

However, when there is no pixel on which a total of two dots per pixel are allotted, dots which overlap each by both the first and second print scans are not generated while a shift between the print scans does not occur. For this reason, except for a situation that a dot size largely exceeds a pixel size, nearly no effect of this embodiment can be obtained.

As has been described above with reference to FIGS. 9A to 9D, a drive block sequence set with which the numbers of overlapping dots by both the first and second print scans are equal to each other even when the ink-landing positions may or may not be shifted by +20 μm in the X direction has been introduced. However, the present invention is not limited to this block sequence set. For example, the same effect can be obtained as long as a drive block sequence upon discharging ink using the first scan image data is different from that upon discharging ink using the second scan image data. However, a sufficient effect cannot be obtained when a drive block sequence required to discharge ink based on the second scan image data is the same as that having a given offset amount from the drive block sequence required to discharge ink based on the first scan image data.

The aforementioned case in which the effect of this embodiment is insufficient will be described below.

FIG. 11 shows an example in which a drive block sequence upon discharging ink based on the second scan image data is the same as that having a given offset amount from a drive block sequence upon discharging ink based on the first scan image data.

FIG. 11 shows the drive block sequences under the assumption that both of printing based on the first scan image data and that based on the second scan image data are attained by carriage scans in the +X direction. Also, assume that when printing is performed by a scan in the −X direction, the drive sequence is set to be a reversed sequence like 16, 15, 14, . . . , 1 so as to obtain the same dot positions to be printed as those of the printing by the scan in the +X direction. That is, the drive block sequence for the first print scan is that of drive block Nos. 1, 5, 9, 13, 2, 6, 10, 14, 3, 7, 11, 15, 4, 8, 12, and 16. By contrast, the drive block sequence for the second print scan is that of drive block Nos. 3, 7, 11, 15, 4, 8, 12, 16, 1, 5, 9, 13, 2, 6, 10, and 14. This sequence is the same as that which is started by shifting the drive block sequence for the first print scan by 8.

FIGS. 12A to 12D show dot allotments when a total of two dots, that is, one dot based on the first scan image data 408-1 and one dot based on the second scan image data 408-2 are printed per pixel with respect to all pixels using the drive block sequence settings shown in FIG. 11.

Figure 12A:
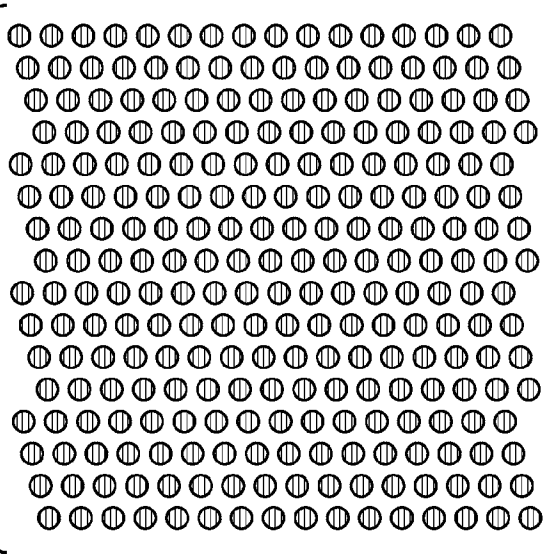
FIGS. 12A, 12B, 12C, and 12D are views showing dot allotments when a total of two dots, that is, one dot based on the first scan image data 408-1 and one dot based on the second scan image data 408-2 are printed per pixel with respect to all pixels using the drive block sequence settings shown in FIG. 11.
Figure 12B:
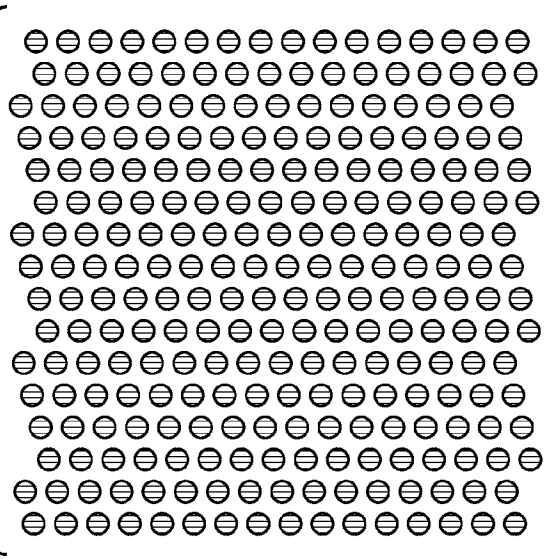
Figure 12C:
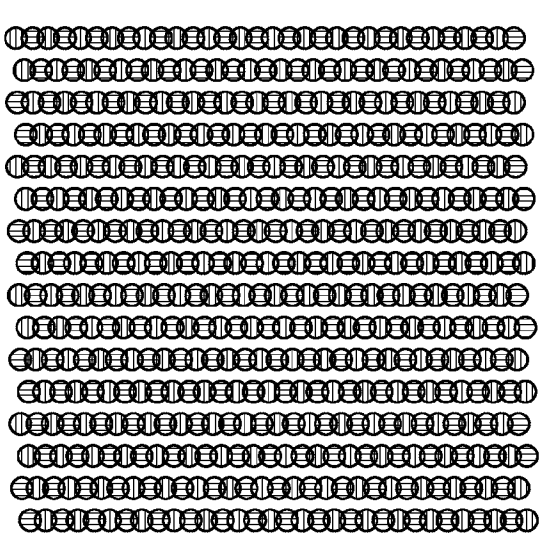
Figure 12D:
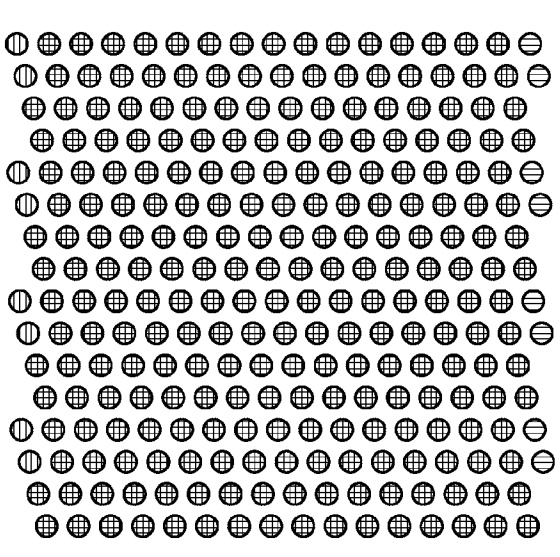

FIGS. 12A to 12D show the same dot allotments as those in FIGS. 7A to 7D, FIGS. 9A to 9D, and FIGS. 10A to 10D. That is, FIG. 12A shows a print dot allotment using only the first scan image data, FIG. 12B shows a print dot allotment using only the second scan image data, and FIG. 12C shows a dot allotment when print dots overlap each other using both the first and second scan image data. FIG. 12D shows a dot allotment when ink-landing positions where dots printed using the second scan image data 408-2 are formed are shifted by +20 μm in the X direction with respect to those printed using the first scan image data.

As can be seen from FIG. 12C, all the pixels are printed without overlapping print dots based on the first scan image data 408-1 and those based on the second scan image data 408-2. On the other hand, in FIG. 12D, print dots of all the pixels overlap each other, and this means that the density is lower than FIG. 12C as a whole.

The fact that the drive block sequence upon discharging ink based on the second scan image data, which is the same as that having a given offset amount from the drive block sequence upon discharging ink based on the first scan image data, means as follows. That is, at all nozzles, distances between ink-landing positions where dots printed using the first and second scan image data are formed are equal to each other.

Since a nozzle of the nozzle No. 1 discharges ink first using the first scan image data, while it discharges ink ninth using the second scan image data, ink based on the second scan image data is discharged while being shifted by +8 (=+21.2

μm) timings at 9600 dpi in the X direction due to their difference. Likewise, since a nozzle of the nozzle No. 2 discharges ink fifth using the first scan image data, while it discharges ink 13th using the second scan image data, ink based on the second scan image data is discharged while being shifted by +8 (=21.2 μm) timings at 9600 dpi in the X direction due to their difference. Since a nozzle of the nozzle No. 3 discharges ink ninth using the first scan image data, while it discharges ink first using the second scan image data, ink based on the second scan image data is discharged while being shifted by −8 (=−21.2 μm) timings at 9600 dpi in the X direction due to their difference.

In this manner, as for the ink-landing position shift, although −8 and +8 are not the same position, since data are available for all the pixels in the this example, a next pixel to be printed by the first scan image data is present at a position of +16 at 600 dpi, that is, 9600 dpi. That is, since inks are discharged to a pixel corresponding to the second scan image data and to a next pixel of a pixel corresponding to the first scan image data while being shifted by +8 (=−8+16) at 9600 dpi in the X direction, ink-landing position shifts −8 and +8 are synonymous. Ink discharge operations based on the first and second scan image data are executed by all the nozzles while being shifted by 8 (=21.2 μm) at 9600 dpi in the X direction. As a result, when a shift of 20 μm is generated between print scans, as shown in FIG. 12D, all dots are allotted to nearly overlap each other.

The aforementioned state is formed when the second scan drive block sequence is shifted by 8 with respect to the first scan drive block sequence, and nearly the same applies to other shift amounts. For example, when the second scan drive block sequence is shift by 4 with respect to the first scan drive block sequence, ink discharge operations based on the first and second scan image data are executed by all the nozzles while being shifted by 4 (=10.6 μm) at 9600 dpi in the X direction. Therefore, when ink-landing positions by the second print scan are shifted by +10 μm with respect to the first print scan, all dots overlap each other, and when ink-landing positions by the second print scan are shifted by −10 μm with respect to the first print scan, all dots do not overlap at all. Since ink-landing position shifts between print scans occur unexpectedly, shifts in either the +X or −X direction may occur. For this reason, the method of setting the second scan drive block sequence to have a given offset amount from the first scan drive block sequence is not sufficiently effective for ink-landing position shifts between print scans.

FIGS. 13A to 13C show drive block sequences and drive sequence gaps. In FIGS. 6, 8, and 11 above, drive blocks are arranged in descending order of number with reference to the drive block sequence. However, in FIGS. 13A to 13C, sequences are rearranged in descending order with reference to the drive block No.

That is, in FIG. 13A, the sequences of FIG. 6 in which the first and second scan drive block sequences are the same are rearranged. In FIG. 13B, the sequences of FIG. 8 in which the first and second scan drive block sequences are different are rearranged. Then, in FIG. 13C, the sequences of FIG. 11 in which the first and second scan drive block sequences are different but which are not effective for ink-landing position shifts are rearranged.

Also, FIGS. 13A to 13C additionally describe a "drive sequence gap" as an indicator. The drive sequence gap is obtained by subtracting the first scan drive sequence from the second scan drive sequence, and when the difference assumes a plus value, the calculated value is described; when it assumes a minus value, a value obtained by adding 16 as the number of drive blocks to the difference is described. As can be seen from FIG. 13B which corresponds to the example effective for ink-landing position shifts between print scans, the drive sequence gaps include "0" indicating the same drive timing and "8" indicating different drive timings, which are alternately arranged between the first and second scans. Note that "8" is a value half of the number of drive blocks=16, and indicates that the time-divisional drive timings are shifted by half a column between the first and second scans. That is, a case of "−8" at a print resolution of 9600 dpi means that an ink-landing position difference equivalent to 21.2 μm is generated.

Therefore, "8" (by adding 16 since 0−8=−8) is added to a drive block No. with a drive sequence gap="0", and "0" (=8−8) is added to a drive block No. with a drive sequence gap="8". Thus, drive sequence gaps are, as shown in FIG. 13C, and the numbers of drive sequence gaps "0" and "8" in a group remain the same as those of a case free from any ink-landing position shifts between print scans. In this case, the drive sequence gaps are only "0" and "8", but in order to achieve goal for suppressing a density change upon occurrence of ink-landing position shifts between print scans, it is important that drive sequence gaps are different in a group since they are canceled out in the group like that a certain nozzle (drive block No.) has a small drive sequence gap, and another nozzle (drive block No.) has a large drive sequence gap.

FIGS. 14A and 14B show another example of the drive block sequences to which the embodiment of the present invention is applied.

FIG. 14A shows drive block Nos. which are arranged in descending order with reference to the drive block sequence, and FIG. 14B shows the sequences which are arranged in descending order with reference to the drive block No. In FIG. 14B, since drive sequence gaps are different for respective nozzles (drive block Nos.), the effect of this embodiment can be obtained by such drive block sequence settings.

FIGS. 15A to 15D show dot allotments when printing is performed using the drive block sequences shown in FIGS. 14A and 14B. FIGS. 15A to 15D show the dot allotments under the same conditions as those of FIGS. 7A to 7D, FIGS. 9A to 9D, FIGS. 10A to 10D, and FIGS. 12A to 12D.

Figure 15A:
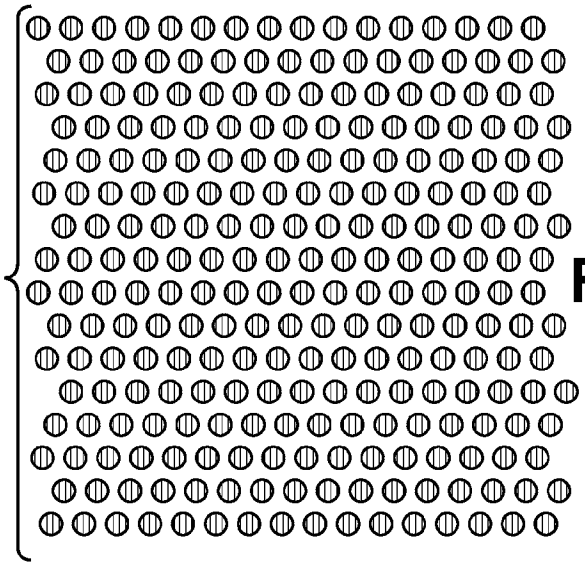
FIGS. 15A, 15B, 15C, and 15D are views showing dot allotments upon printing using the drive sequences shown in FIGS. 14A and 14B.
Figure 15B:
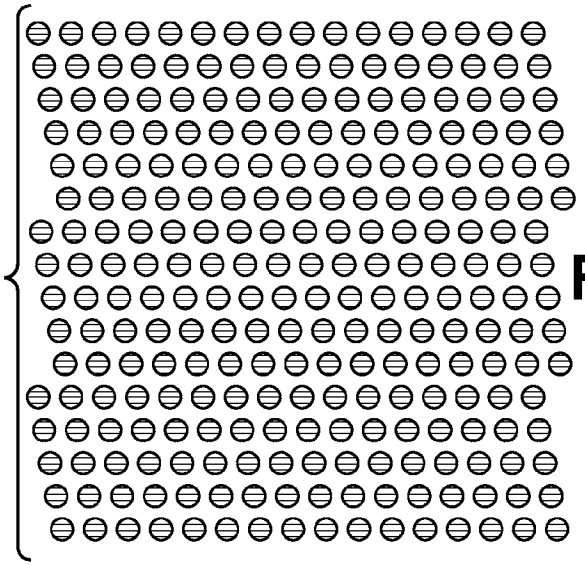
Figure 15C:
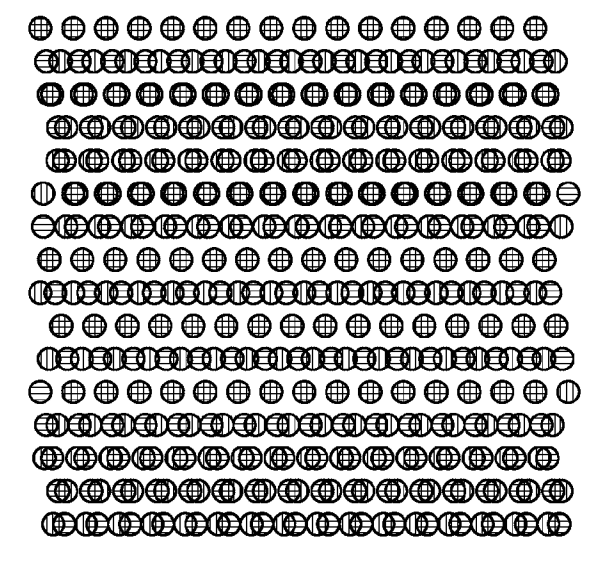
Figure 15D:
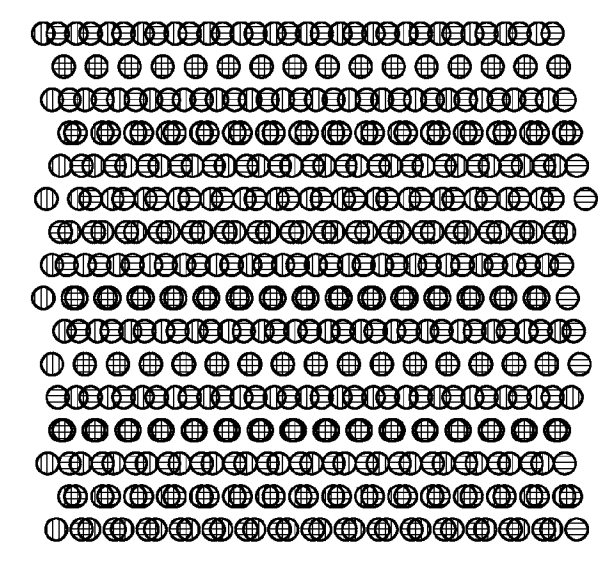

That is, FIG. 15A shows a print dot allotment using only the first scan image data, FIG. 15B shows a print dot allotment using only the second scan image data, and FIG. 15C shows a dot allotment when print dots overlap each other using both the first and second scan image data. FIG. 15D shows a dot allotment when ink-landing positions where dots printed using the second scan image data 408-2 are formed are shifted by +20 μm in the X direction with respect to those printed using the first scan image data.

As can be seen from FIGS. 15C and 15D, no serious density change is observed between FIG. 15C which shows the dot allotment free from any shifts between the print scans, and FIG. 15D which shows the dot allotment when ink-landing positions are shifted by +20 μm between the print scans.

By contrast, as shown in FIGS. 13A and 13C which correspond to the example that is not effective for ink-landing position shifts between the print scans, all the drive sequence gaps are "0" in FIG. 13A, and are "8" in FIG. 13C. In this manner, when all the drive sequence gaps assume the same value, all ink-landing positions from all nozzles (drive block Nos.) are similarly shifted, thus causing a density change as a whole.

According to the aforementioned embodiment, even when one or more dots are allotted per pixel on an average, density unevenness which appear upon occurrence of ink-landing position shifts between print scans can be suppressed.

Second Embodiment

The first embodiment has explained the case in which two image data are completed by two scans. When printing is completed by a small number of scans, if shifts have occurred in the Y direction as the conveyance direction of a print medium, lateral stripes in the X direction become very prominent. This embodiment will explain a printing method which is also effective for shifts in the conveyance direction by increasing the number of scans.

Also, the first embodiment has explained the data generation method which is effective for ink-landing position shifts even in an image in which one dot is allotted at 600 dpi on an average. When print dots are overlaid each other using two image data which are binarized by error diffusion, the advantage described in the first embodiment can be provided, but an disadvantage is also observed, that is, image granularity is enhanced since dot overlapping occurs between print scans. Meanwhile, it is known that density unevenness caused by ink-landing position shifts between print scans is more prominent in an image having a higher density. This embodiment will also explain image data processing effective for ink-landing position shifts between print scans upon printing a high-density image while suppressing image granularity of a low-density image.

Figure 16:
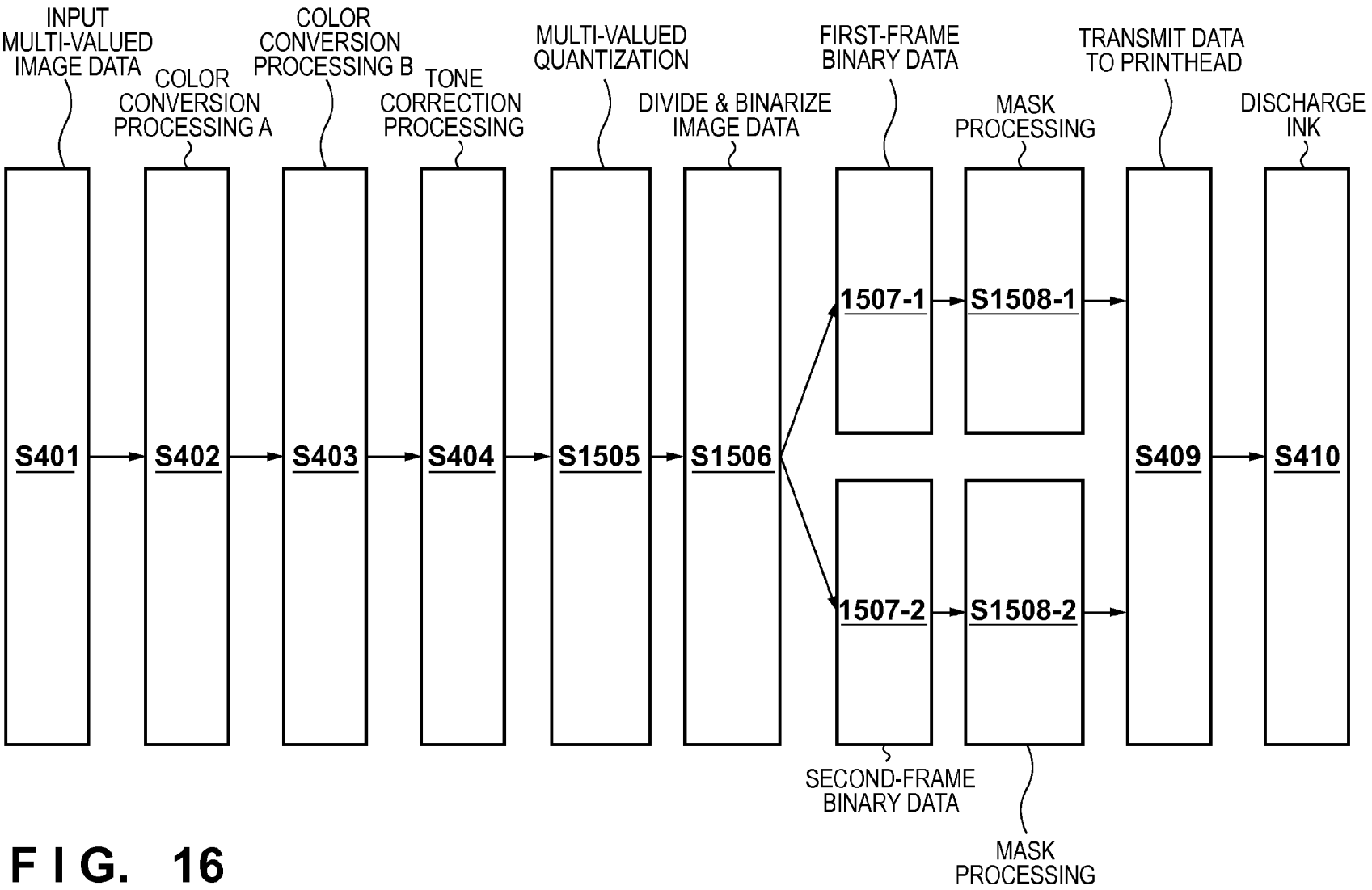
FIG. 16 is a flowchart for explaining processing of multipass printing which completes image printing of a single area by four print scans according to the second embodiment.

FIG. 16 is a flowchart for explaining data processing of multipass printing which completes image printing of a single area by four print scans according to the second embodiment. Note that steps S401 to S404 and steps S409 and S410 are the same processes as those described using FIG. 4 in association with the first embodiment, and a description thereof will not be repeated.

In step S1505, multi-valued quantization is executed.

Figures 17, 18:
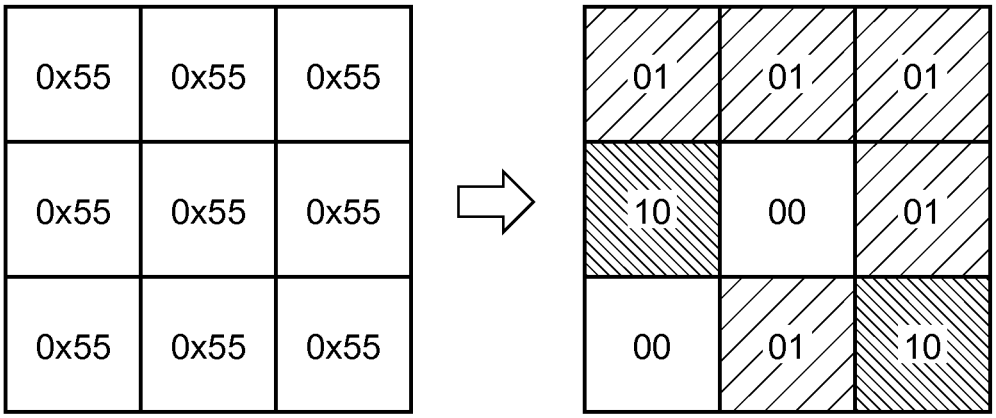
FIG. 17 is a view showing a state in which error diffusion processing is applied to 8-bit image data per pixel to quantize the image data to ternary data.
FIG. 18 shows a table used in two-frame division and binarization processing of ternary quantized data.

FIG. 17 is a view showing a state in which error diffusion processing is applied to 8-bit image data per pixel to quantize the image data to ternary data. As shown in FIG. 17, 8-bit image data (0×55) is quantized to ternary data ("00", "01", or "10") having a 2-bit depth.

Next, in step S1506, image data division and binarization processing are executed for the data, which has undergone the multi-valued quantization, according to a table shown in FIG. 18. In the table shown in FIG. 18, "0" indicates dot print OFF, and "1" indicates dot print ON. In this case, binary image data (first-frame binary data) 1507-1 used in printing on a first frame and binary image data (second-frame binary data) 1507-2 used in printing on a second frame are formed based on the ternary quantized data.

In steps S1508-1 and S1508-2, the binary data 1507-1 and 1507-2 obtained by dividing the ternary quantized data into two frames are masked, thus obtaining masked image data. After that, processes of steps S409 and S410 are executed.

Figure 19:
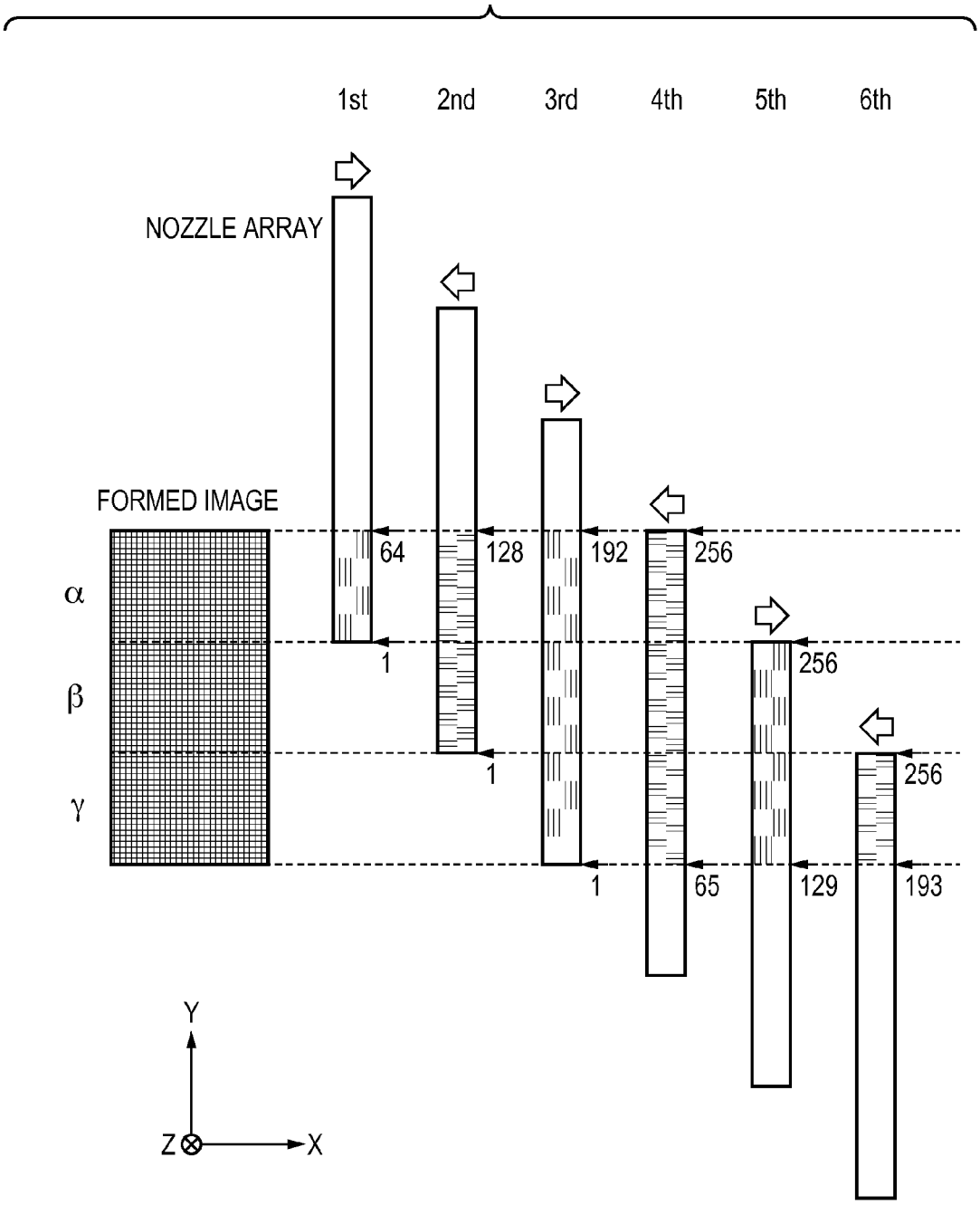
FIG. 19 is a schematic view showing the relation between conveyance of a print medium and nozzle arrays to be used at the time of image formation.
Figure 21A:
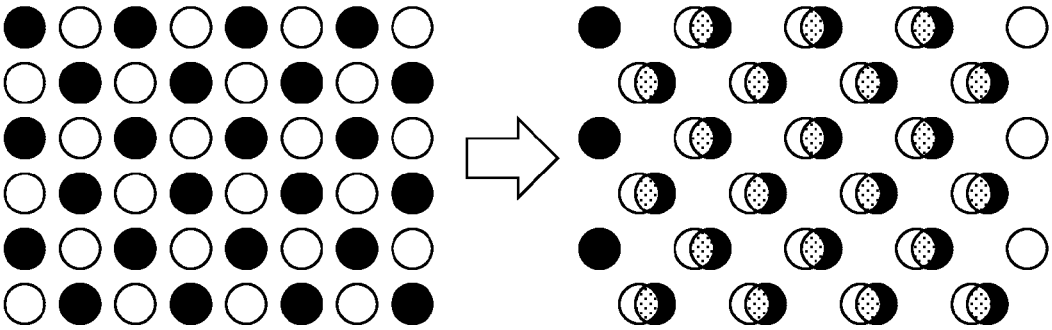
FIGS. 21A, 21B, and 21C are views showing dot allotment differences when shifts between print scans do not occur and when the shifts have occurred in the related art.
Figure 21B:
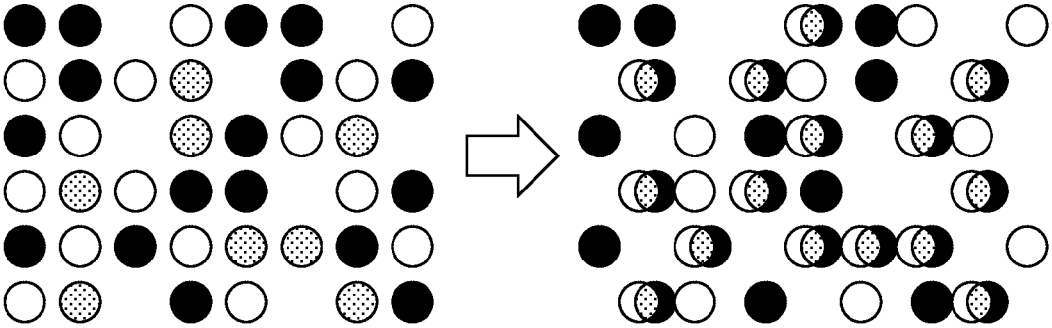
Figure 21C:
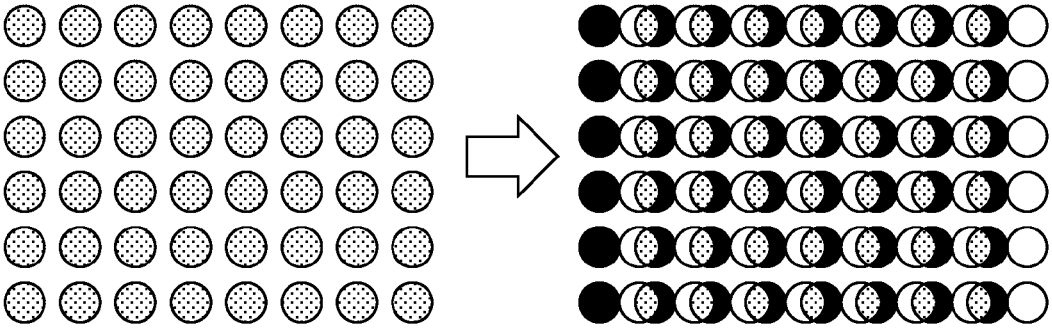

FIG. 19 is a schematic view showing the relation between print medium conveyance and nozzles to be used at the time of image formation. The following description will be given taking the A array as an example of the nozzle array, and the same relation applies to the remaining B to D arrays of the nozzle arrays.

First, using the nozzles of the nozzle Nos. 1 to 64, the carriage is scanned in the +X direction to execute printing. Image data at this time is that obtained by applying a 50% mask A1 to the first-frame image data 1507-1. After this scan, the print medium P is conveyed by 64 nozzles in a unit of 600 dpi in the +Y direction. FIG. 19 shows a relative positional relation between the nozzles and print medium by moving the nozzles in the −Y direction for the sake of convenience.

Second, using the nozzles of the nozzle Nos. 1 to 128, the carriage is scanned in the −X direction to execute printing. Image data at this time is that obtained by applying a 50% mask B1 to the second-frame image data 1507-2. The mark B1 at this time may be the same as or different from the mask A1 applied to the first-frame image data. After this scan, the print medium P is conveyed by 64 nozzles in a unit of 600 dpi in the +Y direction.

Third, using the nozzles of the nozzle Nos. 1 to 192, the carriage is scanned in the +X direction to execute printing. Image data at this time is that obtained by applying a 50% mask A2, which has a complementary relation to the mask A1 applied first, to the first-frame image data 1507-1. After this scan, the print medium P is conveyed by 64 nozzles in a unit of 600 dpi in the +Y direction. Fourth, using the nozzles of the nozzle Nos. 65 to 256, the carriage is scanned in the −X direction to execute printing. Image data at this time is that obtained by applying a 50% mask B2, which has a complementary relation to the mask B1 applied second, to the second-frame image data 1507-2.

Furthermore, fifth, using the nozzles of the nozzle Nos. 129 to 256, the carriage is scanned in the +X direction to execute printing. Print data at this time is that obtained by applying the 50% mask A1, which has a complementary relation to the mask A2 applied third, to the first-frame image data 1507-1. After this scan, the print medium P is conveyed by 64 nozzles in a unit of 600 dpi in the +Y direction. Sixth, using the nozzles of the nozzle Nos. 193 to 256, the carriage is scanned in the −X direction to execute printing. Image data at this time is that obtained by applying the 50% mask B1, which has a complementary relation to the mask B2 applied fourth, to the second-frame image data 1507-2. After this scan, the print medium P is discharged, thus ending printing.

Printing of image areas α, β, and γ to be formed by the aforementioned operations is completed by adding two binary data, that is, the first-frame image data 1507-1 and second-frame image data 1507-2.

FIG. 20 shows drive block sequences used in the second embodiment.

In FIG. 20, both printing operations using the first-frame image (binary) data and second-frame image (binary) data use drive block sequences under the assumption that the scans are made in the +X direction. In case of printing by scans in the −X direction, the drive sequence is set to be a reversed sequence like 16, 15, 14, . . . , 1 so as to obtain the same print dot allotments as that by the scans in the +X direction. The drive block sequence settings shown in FIG. 20 are the same as those shown in FIG. 8 described in the first embodiment.

Allotments of print dots in this embodiment will be described below.

An image including only data quantized to "10" in step S1505 is configured by a total of two dots, that is, one dot based on the first-frame image data 1507-1 and one dot based on the second-frame image data 1507-2, as shown in FIG. 18. This is the same as that in the first embodiment. Therefore, the second embodiment is also effective for ink-landing position shifts between print scans when the drive block sequence settings shown in FIG. 20 are used.

However, the effect is reduced compared to the first embodiment. For example, when ink-landing position shifts have occurred in the fifth scan, the first-frame image data 1507-1 used in the fifth print scan has a complementary relation to the first-frame image data 1507-1 used in the third print scan in association with the image areas β and γ. For this reason, a density changes between these scans. However, since the first-frame image data 1507-1 used in the fifth print scan can suppress a density change against shifts from the second-frame image data 1507-2. Also, since an image, which is printed by two scans in the first embodiment, is printed by four scans in the second embodiment, stripes appeared on a formed image are obscured even when conveyance errors have occurred.

Also, an image including only data quantized to "01" in step S1505 is configured by only one dot of the first-frame image data 1507-1. The image using the first-frame image data 1507-1 is printed to be complemented in the first, third, and fifth scans, thus obtaining an image whose granularity is suppressed.

According to the aforementioned embodiment, density unevenness, which occurs when ink-landing position shifts have occurred between print scans, can be suppressed while suppressing granularity of a low-density image, and occurrence of stripes due to conveyance errors.

Note that in the second embodiment, the first-frame image data is assigned to the first, third, and fifth print scans in the +X direction, and the second-frame image data is assigned to the second, fourth, and sixth print scans in the −X direction. This is because in a printing apparatus which attains printing by reciprocal scans, shifts readily occur when the scan direction is changed. However, unexpected shifts between print scans may occur even when printing is performed by scans in only the +X or −X direction. In consideration of this, print image data for two frames need not always be assigned to match the +X and −X directions.

The second embodiment has explained the method of dividing image data for two frames by masks, and printing an image using these data in four scans. Alternatively, image data for four frames may be generated, and may be printed in four scans without using any masks.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-022474, filed Feb. 3, 2012, which is hereby incorporated by reference herein in its entirety.

What is claimed is:

1. A printing apparatus comprising:

a printhead comprising an element array including a plurality of printing elements, which are arranged in a predetermined direction, which discharge ink, wherein the element array is partitioned into a plurality of groups each including a plurality of continuously arrayed printing elements which are driven in different timings in order;

a scan unit configured to scan said printhead in a direction intersecting the predetermined direction on a single print area on a print medium;

an acquisition unit configured to acquire first print data used for printing in a first scan by the scan unit and second print data used for printing in a second scan by the scan unit, wherein the first print data and the second print data are used to be printed on the single print area on the print medium;

a setting unit configured to set drive sequences of the plurality of printing elements in the first scan and the second scan such that: (1) a driving order of printing elements included in a group used for printing in a first position of the single print area in the predetermined direction based on the first print data and a driving order of printing elements included in a group used for printing in the first position based on the second print data are different from each other, and (2) a a driving order of printing elements included in a group used for printing in a second position, different from the first position, of the single print area in the predetermined direction based on the first print data and a driving order of printing elements included in a group used for printing in the second position based on the second print data are the same; and a drive unit configured to drive the plurality of printing elements in each group based on the drive sequences for the first scan and the second scan.

2. The apparatus according to claim 1, wherein the first print data and the second print data are generated such that at least some pixels on the first position and at least some pixels on the second position are printed in both the first scan and the second scan.

3. The apparatus according to claim 1, wherein said setting unit sets the drive sequences such that the number of printing elements having different positions in a group of the plurality of groups in the predetermined direction and the same driving orders in the group between the first scan and the second scan and the number of printing elements having the same positions in a group of the plurality of groups in the predetermined direction and the same driving orders in the group between the first scan and the second scan are substantially equal to each other.

4. The apparatus according to claim 1, wherein said setting unit sets a difference between a drive timing in the first scan and a drive timing in the second scan of the printing elements having different positions in a group of the plurality of groups in the predetermined direction and the same driving orders in the group to match half a dot column in the direction intersecting with the predetermined direction in printing using the first print data and the second print data.

5. The apparatus according to claim 1, wherein said setting unit sets the drive sequences such that printing elements having the different positions in a group of the plurality of groups in the predetermined direction and the same driving orders in the group between the first scan and the second scan and printing elements having the same positions in a group of the plurality of groups in the predetermined direction and the same driving orders in the group between the first scan and the second scan are alternately arranged.

6. The apparatus according to claim 1, further comprising:

an input unit configured to input multi-valued image data; and a generation unit configured to generate the first print data and the second print data by dividing the multi-valued image data input by said input unit into first multi-valued data used in printing in the first scan and second multi-valued data used in printing in the second scan, and by quantizing the first multi-valued data and the second multi-valued image data.

7. The apparatus according to claim 6, wherein the quantization includes quantization to binary data or quantization to multi-valued data including ternary or more data.

8. The apparatus according to claim 6, wherein said generation unit is further configured to mask the first quantized multi-valued data and the second quantized multi-valued data so as to generate the first print data and the second print data.

9. The apparatus according to claim 1, wherein the group in which the printing elements, used for printing in the first position based on the first print data, are included, is different from the group in which the printing elements, used for printing in the first position based on the second print data, are included.

10. The apparatus according to claim 1, wherein a direction of the first scan and that of the second scan are opposite to each other.

11. A printing control method of a printing apparatus, which includes a printhead comprising an element array including a plurality of printing elements, which are arranged in a predetermined direction, which discharge ink, and attains printing by reciprocally scanning the printhead in a direction intersecting the predetermined direction on a single print area on a print medium, wherein the element array is partitioned into a plurality of groups each including a plurality of continuously arrayed printing elements which are driven in different timings in order, the method comprising:

acquiring first print data used in printing in a first scan and second print data used in printing in a second scan, wherein the first print data and the second print data are used to be printed on a single print area on a print medium;

setting drive sequences of the plurality of printing elements in the first scan and the second scan such that: (1) a driving order of printing elements included in a group used for printing in a first position of the single print area in the predetermined direction based on the first print data and a driving order of printing elements included in a group used for printing in the first position based on the second print data are different from each other, and (2) a driving order of printing elements included in a group used for printing in a second position, different from the first position, of the single print area in the predetermined direction based on the first print data and a driving order of printing elements included in a group used for printing in the second position based on the second print data are the same; and driving the plurality of printing elements in said each group based on the drive sequences for the first scan and the second scan.

12. The method according to claim 11, wherein the first print data and the second print data are generated such that at least some pixels on the first position and at least some pixels on the second position are printed in both the first scan and the second scan.

13. The method according to claim 11, wherein in the setting, the drive sequences are set such that the number of printing elements having different positions in a group of the plurality of groups in the predetermined direction and the same driving orders in the group between the first scan and the second scan and the number of printing elements having the same positions in a group of the plurality of groups in the predetermined direction and the same driving orders in the group between the first scan and the second scan are substantially equal to each other.

14. The method according to claim 11, wherein in the setting, a difference between a drive timing in the first scan and a drive timing in the second scan of the printing element having different positions in a group of the plurality of groups in the predetermined direction and the same driving orders in the group is set to match half a dot column in the direction intersecting with the predetermined direction in printing using the first print data and the second print data.

15. The method according to claim 11, wherein in the setting, the drive sequences are set such that printing elements having different positions in a group of the plurality of groups in the predetermined direction and the same driving orders in the group between the first scan and the second scan and printing elements having the same positions in a group of the plurality of groups in the predetermined direction and the same driving orders in the group between the first scan and the second scan are alternately arranged.

16. The method according to claim 11, further comprising:

inputting multi-valued image data; and generating the first print data and the second print data by dividing the input multi-valued image data into first multi-valued data used in printing in the first scan and second multi-valued data used in printing in the second scan, and by quantizing the first multi-valued data and the second multi-valued image data.

17. The method according to claim 16, wherein the quantization includes quantization to binary data or quantization to multi-valued data including ternary or more data.

18. The method according to claim 16, wherein in the generating, the first quantized multi-valued data and the second quantized multi-valued data are further masked so as to generate the first print data and the second print data.

19. A printing apparatus comprising:

a printhead comprising an element array including a plurality of printing elements, which are arranged in a predetermined direction, which discharge ink, wherein the element array is partitioned into a plurality of groups each including a plurality of continuously arrayed printing elements which are driven in different timings in order;

a scan unit configured to scan said printhead in a direction intersecting with the predetermined direction on a single print area on a print medium; and a setting unit configured to set drive sequences of the plurality of printing elements in a first scan by the scan unit and a second scan by the scan unit such that: (1) a driving order of printing elements included in a group used for printing in a first position of the single print area in the predetermined direction by the first scan and a driving order of printing elements included in a group used for printing in the first position by the second scan are different from each other, and (2) a driving order of printing elements included in a group used for printing in a second position, different from the first position, of the single print area in the predetermined direction by the first scan and a driving order of printing elements included in a group used for printing in the second position by the second scan are the same.

20. A printing apparatus for printing an image comprising:

a printhead having an element array in which a plurality of printing elements for discharging ink are arranged in a predetermined direction;

a scanning unit configured to cause the printhead to perform a first scan over a predetermined area in a first direction which crosses the predetermined direction and a second scan over the predetermined area in the first direction;

an acquiring unit configured to acquire first print data used for printing in the first scan in the predetermined area by the scanning unit and second print data used for printing in the second scan in the predetermined area by the scanning unit;

a driving control unit configured to control (i) driving of first printing elements, among the plurality of printing elements, corresponding to the predetermined area in the first scan so as to be driven at different timings with respect to each of first driving blocks obtained by dividing the first printing elements and (ii) driving of second printing elements, among the plurality of printing elements, corresponding to the predetermined area in the second scan so as to be driven at different timings with respect to each of second driving blocks obtained by dividing the second printing elements, wherein the second driving blocks correspond to the first driving blocks, respectively, and a discharge control unit configured to control discharging ink to the predetermined area by causing the printhead to drive the first printing elements and the second printing elements by the driving control unit, based on the first print data and the second print data acquired by the acquiring unit, wherein a driving order of the second driving blocks is different from both of a driving order of the first driving blocks and a driving order obtained by offsetting the driving order of the first driving blocks.

21. The apparatus according to claim 20, wherein the first print data and the second print data are determined such that a position of at least one pixel determined by discharging ink based on the first print data is the same as that of one pixel determined by discharging ink based on the second print data.

22. The apparatus according to claim 21, further comprising:

a second acquiring unit configured to acquire multi-valued data corresponding to the image; and a generating unit configured to generate the first print data and the second print data, based on the multi-valued data acquired by the second acquiring unit.

23. The apparatus according to claim 22, wherein the generating unit comprises:

a first generating unit configured to generate first multi-valued data corresponding to the first scan and second multi-valued data corresponding to the second scan by dividing the multi-valued data acquired by the second acquiring unit; and a second generating unit configured to generate the first print data by quantizing the first multi-valued data generated by the first generating unit, and generate the second print data by quantizing the second multi-valued data generated by the first generating unit.

24. The apparatus according to claim 22, wherein the generating unit comprises:

a first generating unit configured to generate quantized data by quantizing the multi-valued data acquired by the second acquiring unit; and a second generating unit configured to generate the first print data and the second print data by dividing the quantized data generated by the first generating unit.

25. The apparatus according to claim 24, wherein the quantized data is ternary data.

26. The apparatus according to claim 25, wherein the second generating unit generates the first print data and the second print data by using a predetermined table which defines relationship among the quantized data, the first print data, and the second print data such that:

(i) in a case where a value of the quantized data corresponding to one pixel is a first value, both of the first print data corresponding to the one pixel and the second print data corresponding to the one pixel are determined as discharging ink;

(ii) in a case where the value of the quantized data corresponding to one pixel is a second value different from the first value, the first print data corresponding to the one pixel is determined as discharging ink and the second print data corresponding to the one pixel is determined as not discharging ink; and (iii) in a case where the value of the quantized data corresponding to one pixel is a third value different from the first value and the second value, both of the first print data corresponding to the one pixel and the second print data corresponding to the one pixel are determined as discharging ink.

27. The apparatus according to claim 20, wherein the first printing elements are adjacent to each other in the predetermined direction, and belong to different driving blocks of the first driving blocks, and the second printing elements are adjacent to each other in the predetermined direction, and belong to different driving blocks of the second driving blocks.

28. A printing apparatus for printing an image comprising:

a printhead having an element array in which a plurality of printing elements for discharging ink are arranged in a predetermined direction;

a scanning unit configured to cause the printhead to perform a first scan over a predetermined area in a first direction which crosses the predetermined direction and a second scan over the predetermined area in a second direction which crosses the predetermined direction and is opposite to the first direction;

an acquiring unit configured to acquire first print data used for printing in the first scan in the predetermined area by the scanning unit and second print data used for printing in the second scan in the predetermined area by the scanning unit;

a driving control unit configured to control (i) driving of first printing elements, among the plurality of printing elements, corresponding to the predetermined area in the first scan so as to be driven at different timings with respect to each of first driving blocks obtained by dividing the first printing elements and (ii) driving of second printing elements, among the plurality of printing elements, corresponding to the predetermined area in the second scan so as to be driven at different timings with respect to each of second driving blocks obtained by dividing the second printing elements, wherein the second driving blocks correspond to the first driving blocks, respectively, and a discharging control unit configured to control discharging ink to the predetermined area by causing the printhead to drive the first printing elements and the second printing elements by the driving control unit, based on the first print data and the second print data acquired by the acquiring unit, wherein a driving order of the second driving blocks is different from both of an order obtained by reversing a driving order of the first driving blocks and a driving order obtained by reversing and offsetting the driving order of the first driving blocks.

29. The apparatus according to claim 28, wherein the first print data and the second print data are determined such that a position of at least one pixel determined by discharging ink based on the first print data is a same as that of one pixel determined by discharging ink based on the second print data.

30. The apparatus according to claim 29, further comprising:

a second acquiring unit configured to acquire multi-valued data corresponding to the image; and a generating unit configured to generate the first print data and the second print data based on the multi-valued data acquired by the second acquiring unit.

31. The apparatus according to claim 30, wherein the generating unit comprises:

a first generating unit configured to generate first multi-valued data corresponding to the first scan and second multi-valued data corresponding to the second scan by dividing the multi-valued data acquired by the second acquiring unit; and a second generating unit configured to generate the first print data by quantizing the first multi-valued data generated by the first generating unit, and generate the second print data by quantizing the second multi-valued data generated by the first generating unit.

32. The apparatus according to claim 30, wherein the generating unit comprises:

a first generating unit configured to generate quantized data by quantizing the multi-valued data acquired by the second acquiring unit; and a second generating unit configured to generate the first print data and the second print data by dividing the quantized data generated by the first generating unit.

33. The printing apparatus according to claim 32, wherein the quantized data is ternary data.

34. The printing apparatus according to claim 33, wherein the second generating unit generates the first print data and the second print data by using a predetermined table which defines relationship among the quantized data, the first print data, and the second print data such that:

(i) in a case where a value of the quantized data corresponding to one pixel is a first value, both of the first print data corresponding to the one pixel and the second print data corresponding to the one pixel are determined as not discharging ink;

(ii) in a case where the value of the quantized data corresponding to one pixel is a second value different from the first value, the first print data corresponding to the one pixel is determined as discharging ink and the second print data corresponding to the one pixel is determined as not discharging ink; and (iii) in a case where the value of the quantized data corresponding to one pixel is a third value different from the first value and the second value, both of the first print data corresponding to the one pixel and the second print data corresponding to the one pixel are determined as discharging ink.

35. The apparatus according to claim 28, wherein the first printing elements are adjacent to each other in the predetermined direction, and belong to different driving blocks of the first driving blocks, and the second printing elements are adjacent to each other in the predetermined direction, and belong to different driving blocks of the second driving blocks.

36. A printing apparatus for printing an image comprising:

a printhead having an element array in which a plurality of printing elements for discharging ink are arranged in a predetermined direction;

a scanning unit configured to cause the printhead to perform a first scan over a predetermined area in a first direction which crosses the predetermined direction and a second scan over the predetermined area in a second direction which crosses the predetermined direction and is opposite to the first direction;

an acquiring unit configured to acquire first print data used for printing in the first scan in the predetermined area by the scanning unit and second print data used for printing in the second scan in the predetermined area by the scanning unit;

a driving control unit configured to drive (i) first printing elements, among the plurality of printing elements, corresponding to the predetermined area in the first scan so as to be driven at different timings with respect to each of first driving blocks obtained by dividing the first printing elements and (ii) second printing elements, among the plurality of printing elements, corresponding to the predetermined area in the second scan so as to be driven at different timings with respect to each of second driving blocks obtained by dividing the second printing elements, wherein the second driving blocks correspond to the first driving blocks, respectively, and a discharging control unit configured to control discharging ink to the predetermined area by causing the printhead to drive the first printing elements and the second printing elements by the driving control unit, based on the first print data and the second print data acquired by the acquiring unit, wherein the first print data and the second print data are determined such that the printhead discharges ink to each pixel position in the predetermined area in the first scan and the second scan, respectively, and the driving control unit drives the first printing elements and the second printing elements such that dot allotment includes portions where dots printed using the first print data and the second print data overlap each other and portions where dots are shifted without overlapping each other.

* * * * *